US008870600B2

(12) United States Patent
Wu et al.

(10) Patent No.: US 8,870,600 B2
(45) Date of Patent: Oct. 28, 2014

(54) CONNECTOR WITH STAGGERED CONTACTS

(71) Applicant: Samtec, Inc., New Albany, IN (US)

(72) Inventors: Feng-Nan Wu, Taipei (TW); Chia-Chi Cheng, New Taipei (TW)

(73) Assignee: Samtec, Inc., New Albany, IN (US)

( * ) Notice: Subject to any disclaimer, the term of this patent is extended or adjusted under 35 U.S.C. 154(b) by 59 days.

(21) Appl. No.: 13/753,715

(22) Filed: Jan. 30, 2013

(65) Prior Publication Data

US 2014/0213124 A1 Jul. 31, 2014

(51) Int. Cl.

| | |
|---|---|
| ***H01R 24/00*** | (2011.01) |
| ***H01R 13/05*** | (2006.01) |
| ***H01R 12/58*** | (2011.01) |
| ***H01R 13/6467*** | (2011.01) |
| *H01R 107/00* | (2006.01) |

(52) U.S. Cl.

CPC ..... *H01R 13/05* (2013.01); *H01R 12/585* (2013.01); *H01R 13/6467* (2013.01); *H01R 2107/00* (2013.01)

USPC ..... 439/637

(58) Field of Classification Search

USPC ..... 439/636, 637

See application file for complete search history.

(56) References Cited

U.S. PATENT DOCUMENTS

| | | | | |
|---|---|---|---|---|
| 4,619,495 | A * | 10/1986 | Sochor | 439/637 |
| 5,259,793 | A | 11/1993 | Yamada et al. | |
| 5,401,186 | A | 3/1995 | Nozaki et al. | |
| 6,338,630 | B1 * | 1/2002 | Dong | 439/74 |
| 6,394,823 | B1 * | 5/2002 | Dunham et al. | 439/108 |
| 6,666,711 | B2 | 12/2003 | Takashita et al. | |
| 7,270,573 | B2 | 9/2007 | Houtz | |
| 7,338,318 | B2 | 3/2008 | Shen et al. | |
| 2003/0119366 | A1 | 6/2003 | Wu | |
| 2009/0227145 | A1 | 9/2009 | Davis et al. | |

FOREIGN PATENT DOCUMENTS

JP 2568729 Y2 4/1998

OTHER PUBLICATIONS

Official Communication issued in corresponding International Application PCT/US2013/069979, mailed on Feb. 27, 2014.

* cited by examiner

*Primary Examiner* — Ross Gushi

(74) *Attorney, Agent, or Firm* — Keating & Bennett, LLP

(57) ABSTRACT

A connector includes at least one first contact and at least one second contact. Each of the at least one first contact and the at least one second contact includes a tail with a leg extending therefrom and an arm with a contact section arranged to electrically couple with a corresponding contact when the connector is mated to an electrical device or another connector. The leg of each of the at least one first contact is offset with respect to the leg of each of the at least one second contact.

19 Claims, 23 Drawing Sheets

CONNECTOR WITH STAGGERED CONTACTS

BACKGROUND OF THE INVENTION

1. Field of the Invention

The present invention relates to connectors. More specifically, the present invention relates to connectors with contacts inserted therein, the contacts including staggered portions.

2. Description of the Related Art

Connectors are used to place electrical devices in communication with one another. A connector includes contacts that transmit signals to an electrical device or another connector.

Connectors may be connected to printed circuit boards. One type of connector includes a connector body into which contacts are inserted after the connector body is manufactured. FIGS. 14A to 15 show an example of a known connector 3000 that includes contacts 1000 shown in FIG. 13. FIG. 13 is a side view of the contact 1000. FIG. 14A is a top perspective view of the known connector 3000. FIG. 14B is a bottom perspective view of the known connector 3000. FIG. 15 is a top perspective cross-sectional view of the known connector 3000.

As shown in FIG. 13, a contact 1000 includes a base section 1010 with a tail 1011, an arm 1021, and a barb 1031 extending from the base section 1010. The tail 1011 includes a stub 1014 for mechanically supporting the contact 1000 in the connector 3000, and a leg 1013 for connecting the connector 3000 to a printed circuit board (not shown). Solder may be deposited on the leg 1013 to help form a mechanical and electrical connection between the connector 3000 and the printed circuit board. Typically, the connector 3000 would be reflowed/soldered to the printed circuit board. Instead of providing the solder on the leg 1013 of the contact 1000, the fusible material or solder could be provided on the printed circuit board to which the connector 3000 is to be soldered.

The arm 1021 of the contact 1000 includes a contact section 1020 that contacts a corresponding contact when the connector 3000 is mated to a printed circuit board or another connector. The arm 1021 of the contact 1000 fits a slot 3031 along an inner wall 3030 of the connector 3000. The barb 1031 of the contact 1000 includes a tip 1030 that is arranged to be inserted into a barb hole 3040 of the connector 3000. The barb 1031, when inserted into the barb hole 3040, helps to secure and position the contact 1000 in the connector 3000. The barb hole 3040 may pass fully through the connector 3000, thereby providing access to the tip 1030 to aid in insertion and removal of the contact 1000 from the connector 3000.

The connector 3000 also includes alignment pins 3070, which guide the connector 3000 to the proper location and orientation on a printed circuit board to which the connector 3000 is to be attached.

As described above, the connector 3000 is connected to a printed circuit board by solder. Another method of connecting a connector to a printed circuit board is by a press-fit engagement with the printed circuit board. In press-fit mounting, a connector is pressed down on a printed circuit board with a force large enough to fully insert contacts of the connector into corresponding plated through-holes in the printed circuit board.

The connector 3000 is only suitable to be connected to a printed circuit board by solder, due to the contacts 1000 being arranged to be inserted into the connector 3000 in a press-fit manner. The press-fit arrangement of the contacts 1000 also allows the connector 3000 to be connected to a printed circuit board without the need for a reflow oven.

Furthermore, since the legs 1013, the stubs 1014, and the barbs 1031 of each of the contacts 1000 in the connector 3000 are all substantially aligned with each other adjacent contacts 1000 may cause undesirable signal interference with each other.

SUMMARY OF THE INVENTION

To overcome the problems described above, preferred embodiments of the present invention provide a connector that can be press-fit to a printed circuit board while reducing signal interference between contacts.

A connector according to a preferred embodiment of the present invention includes at least one first contact and at least one second contact. The at least one first contact and the at least one second contact each include a tail with a leg extending therefrom and an arm with a contact section arranged to electrically couple with a corresponding contact when the connector is mated to an electrical device or another connector. Further, the leg of each of the at least one first contact is offset with respect to the leg of each of the at least one second contact.

The leg of each of the at least one first contact and the at least one second contact is preferably arranged to be press-fit into a mounting hole of a substrate. The tail of each of the at least one first contact is preferably shorter than the tail of each of the at least one second contact. The tail of each of the at least one first contact is preferably arranged to be the same or substantially the same as the tail of each of the at least one second contact. The tail of each of the at least one first contact preferably includes a stub arranged to separate the leg of each of the at least one first contact from an end of each of the at least one first contact by a predetermined distance. The leg of each of the at least one second contact is preferably arranged at an end of each of the at least one second contact.

The at least one first contact and the at least one second contact each preferably include a barb arranged to fit one of a plurality of barb holes of the connector. Further, the barb of each of the at least one first contact and the at least one second contact is preferably tapered. The barb of each of the at least one first contact and the at least one second contact is preferably tapered at an angle of less than about 90 degrees.

The leg of each of the at least one first contact and the at least one second contact is preferably offset with respect to the arm of the at least one first contact and the at least one second contact. The at least one first contact and the at least one second contact each preferably include a base section, and the leg, the arm, and the barb of each of the at least one first contact and the at least one second contact are preferably arranged along the base section of each of the at least one first contact and the at least one second contact, such that the barb is disposed between the leg and the arm.

The leg of each of the at least one first contact and the at least one second contact is preferably perpendicular or substantially perpendicular to the arm of the at least one first contact and the at least one second contact. The at least one first contact and the at least one second contact are preferably arranged in an alternating manner in the connector.

The at least one first contact and the at least one second contact are preferably arranged in at least one row in a connector body of the connector. The at least one first contact and the at least one second contact are preferably parallel or substantially parallel with respect to each other. The connector body preferably extends to an end of each of the tails of each of the at least one first contact and the at least one second contact. A portion of at least one of the tails of the at least one first contact and the at least one second contact preferably extends outside of the connector body. The connector body preferably includes a plastic material.

A connector assembly according to a preferred embodiment of the present invention includes a substrate with a plurality of mounting holes and a connector with at least one first contact and at least one second contact. The at least one first contact and the at least one second contact of the connector each include a tail with a leg extending therefrom and an arm with a contact section arranged to electrically couple with a corresponding contact when the connector is mated to an electrical device or another connector. The leg of each of the at least one first contact is offset with respect to the leg of each of the at least one second contact, and the leg of each of the at least one first contact and the at least one second contact is arranged to be press-fit into a corresponding one of the plurality of mounting holes of the substrate. Preferably, the substrate is a printed circuit board.

The above and other features, elements, characteristics, and advantages of the present invention will become more apparent from the following detailed description of the preferred embodiments of the present invention with reference to the attached drawings.

DETAILED DESCRIPTION OF THE PREFERRED EMBODIMENTS

Preferred embodiments of the present invention will now be described in detail with reference to FIGS. 1A to 12. Note that the following description is in all aspects illustrative and not restrictive, and should not be construed to restrict the applications or uses of the present invention in any manner.

Figure 1A:
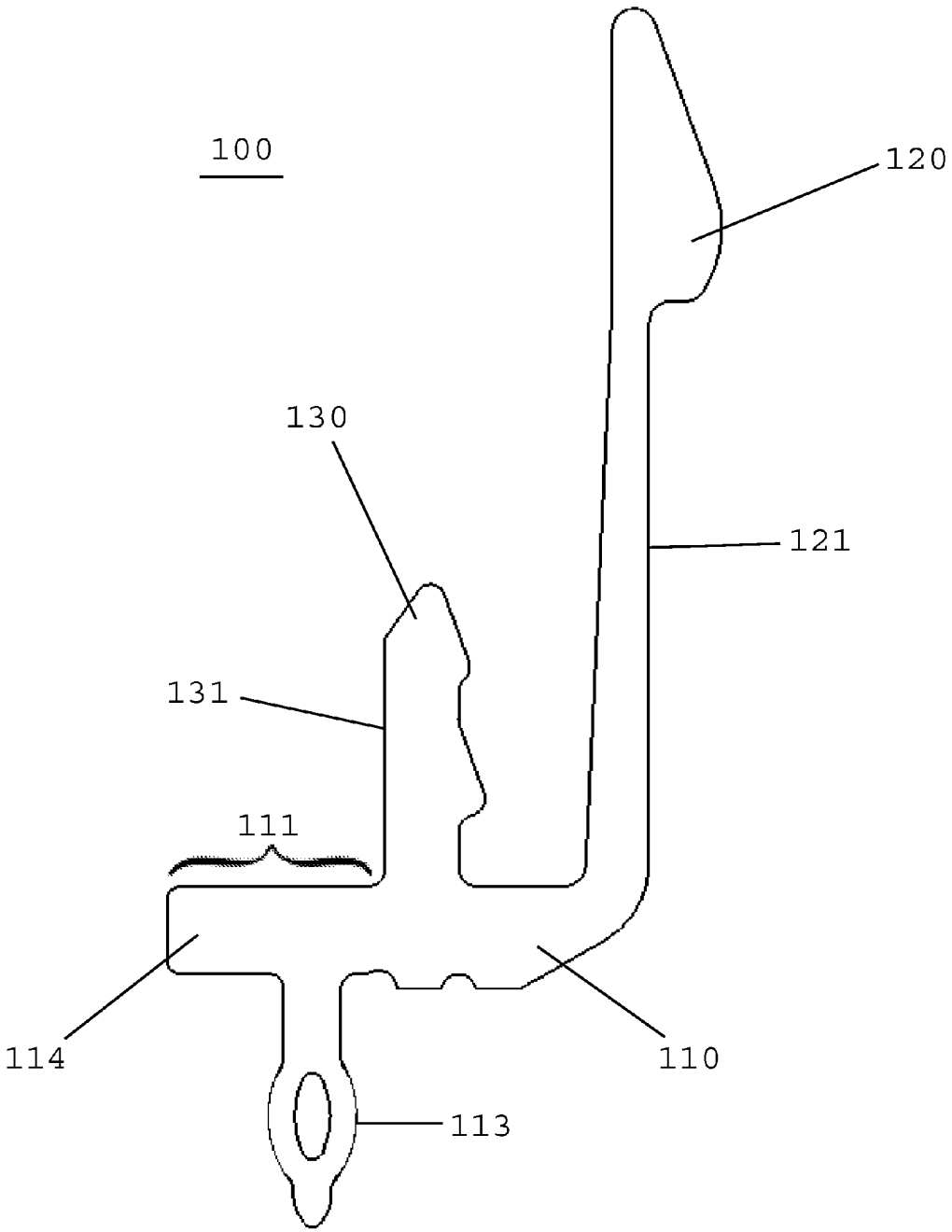
FIG. 1A is a view of a contact with a stub in accordance with a preferred embodiment of the present invention.

FIG. 1A is a view of a contact 100 in accordance with a preferred embodiment of the present invention. As shown in FIG. 1A, contact 100 includes a base section 110 with a tail 111, an arm 121, and a barb 131 extending from the arm 121. The tail 111 extends from the barb 131 to an end of the contact 100 that is opposite to the arm 121 and includes a stub 114 that mechanically supports the contact 100 in a connector, for example, a connector 400 shown in FIGS. 5A to 6B and a connector 500 shown in FIGS. 7-9. A leg 113 extending from the tail 111 electrically and mechanically connects the contact 100 to a substrate, which is typically a printed circuit board or other suitable substrate. The leg 113 is offset from the arm 121 and the barb 131.

Preferably, the leg 113 includes a through-hole (e.g., an "eye-of-the-needle" configuration) to provide an oversize fit for press-fit mounting applications. Accordingly, when the leg 113 is press-fit into a corresponding mounting hole in a substrate, the leg 113 deforms to fit the corresponding mounting hole in the substrate to provide a secure electrical and mechanical connection between the contact 100 and the substrate.

The arm 121 of the contact 100 includes a contact section 120 that contacts an electrical pad on a substrate when a connector including the contact 100 is mated with the substrate. However, the contact section 120 could also contact a corresponding contact of an electrical device or another connector. In particular, the contact 100 could be included in an edge-card connector such that the contact section 120 of the contact 100 contacts an electrical pad near the edge of a printed circuit board. The arm 121 being offset from the leg 113 allows the arm 121 to cantilever and maintain flexibility when the contact 100 is inserted into the connector, thereby providing a secure electrical and mechanical connection.

The barb 131 of the contact 100 includes a tip 130 that penetrates a connector to secure and position the contact 100 within the connector. Furthermore, as compared with the tip 1030 of the known contact 1000 shown in FIG. 11, the tip 130 of the contact 100 is preferably sharpened, or tapered, to a triangular shape, such that the barb 131 has a more acute angle near the end of the tip 130. Preferably, the barb 131 also has a shorter length than the barb 1031 of the known contact 1000. Accordingly, this narrow profile of the tip 130 improves an impedance profile of the contact 100 and allows for easier insertion of the contact 100 into a connector. In particular, the impedance may be improved, for example, from about 49Ω to about 54Ω by replacing the barb 1031 with the barb 131. Furthermore, sharpening or tapering the tip 130 and shortening the barb 131 of the contact 100 improves discontinuities in the signal response of the contact 100. The barb 131 being offset from the leg 113 allows force to be applied at an area of the bottom of the base section 110 that is opposite to the barb 131 when the contact 100 is inserted into a connector, thereby providing easier insertion of the contact 100 into the connector. Furthermore, this area of the bottom of the base section 110 provides a preferred attachment point for the contact 100 to be joined to a contact carrier (not shown). Horizontally separating the barb 131 from the arm 121 allows the vertical height of the contact 100, and thus the connector into which the contact 100 will be inserted, to be smaller.

Figure 1B:
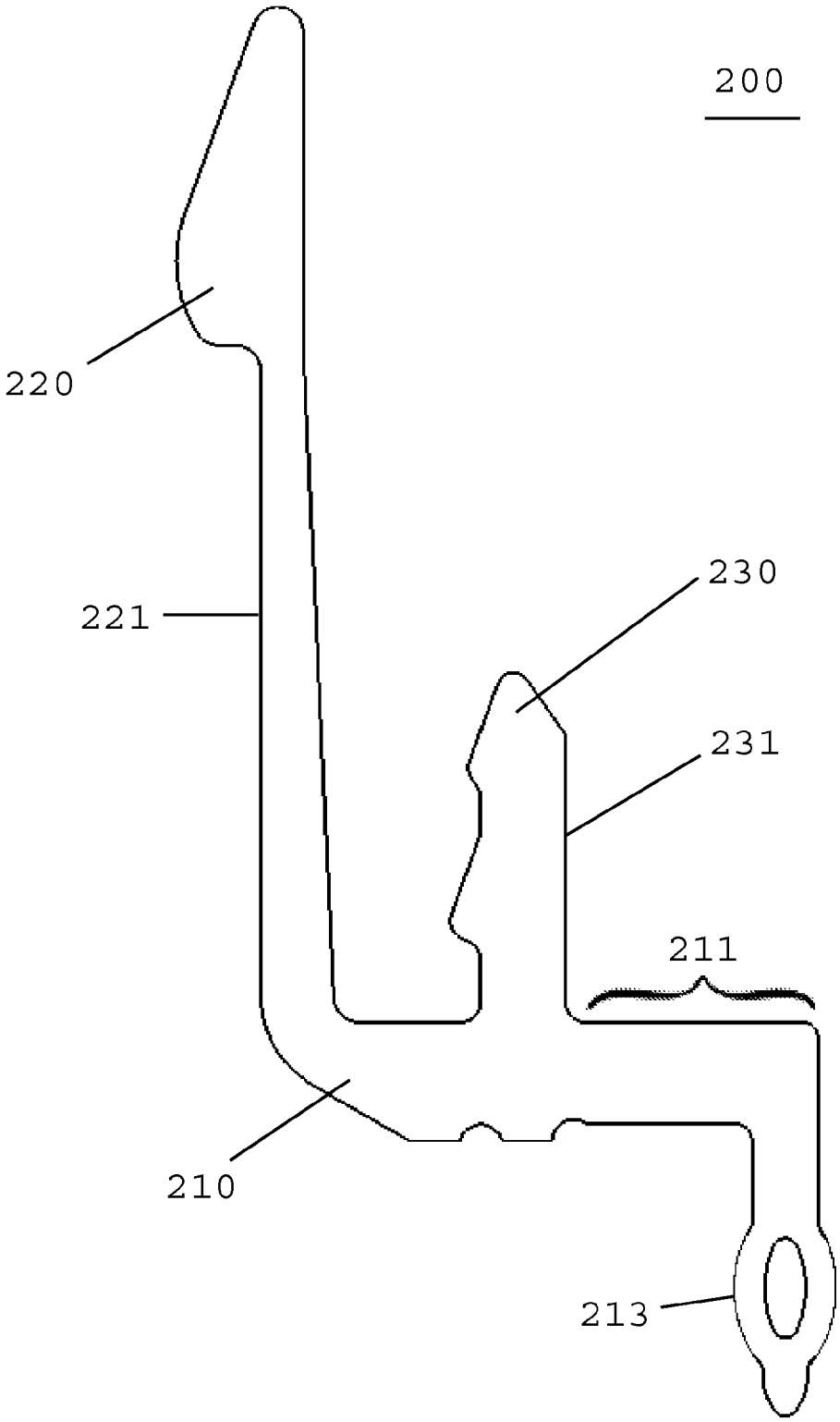
FIG. 1B is a view of a contact without a stub in accordance with a preferred embodiment of the present invention.

FIG. 1B is a view of a contact 200 in accordance with a preferred embodiment of the present invention. As shown in FIG. 1B, contact 200 includes a base section 210 with a tail 211, an arm 221, and a barb 231 extending from the arm 221. The tail 211 extends from the barb 231 to an end of the contact 200 that is opposite to the arm 221. A leg 213 extending from the tail 211 electrically and mechanically connects the contact 200 to a substrate, for example, a printed circuit board (not shown). The leg 213 is offset from the arm 221 and the barb 231.

Preferably, the leg 213 includes a through-hole (e.g., an "eye-of-the-needle" configuration) to provide an oversize fit for press-fit mounting applications. Accordingly, when the leg 213 is press-fit into a corresponding mounting hole in a substrate, the leg 213 deforms to fit the corresponding mounting hole in the substrate to provide a secure electrical and mechanical connection between the contact 200 and the substrate.

The arm 221 of the contact 200 includes a contact section 220 that contacts an electrical pad on a substrate when a connector including the contact 200 is mated with the substrate. However, the contact section 220 could also contact a corresponding contact of an electrical device or another connector. In particular, the contact 200 could be included in an edge-card connector such that the contact section 220 of the contact 200 contacts an electrical pad near the edge of a printed circuit board. The arm 221 being offset from the leg 213 allows the arm 221 to cantilever and maintain flexibility when the contact 200 is inserted into the connector, thereby providing a secure electrical and mechanical connection.

The barb 231 of the contact 200 includes a tip 230 that penetrates a connector to secure and position the contact 200 within the connector. Furthermore, as compared with the tip 1030 of the known contact 1000 shown in FIG. 11, the tip 230 of contact 200 is preferably sharpened, or tapered, to a triangular shape, such that the barb 231 has a more acute angle near the end of the tip 230. Preferably, the barb 231 also has a shorter length than the barb 1031 of the known contact 1000. Accordingly, this narrow profile of the tip 230 improves an impedance profile of the contact 200 and allows for easier insertion of the contact 200 into a connector. In particular, sharpening or tapering the tip 230 and shortening the barb 231 of the contact 200 improves discontinuities in the signal response of the contact 200. The barb 231 being offset from the leg 213 allows force to be applied at an area of the bottom of the base section 210 that is opposite to the barb 231 when the contact 200 is inserted into a connector, thereby providing easier insertion of the contact 200 into the connector. Furthermore, this area of the bottom of the base section 210 provides a preferred attachment point for the contact 200 to be joined to a contact carrier (not shown). Horizontally separating the barb 231 from the arm 221 allows the vertical height of the contact 200, and thus the connector into which the contact 200 will be inserted, to be smaller.

Accordingly, as compared with the contact 100 as shown in FIG. 1A, the contact 200 as shown in FIG. 1B does not include a stub, such as stub 114 of connector 100, at an end of the tail 211. However, the tail 211 preferably has a length that is the same or substantially the same, within manufacturing tolerances, as the tail 111 of contact 100. That is, the distance of the barb 131 from an end of the contact 100 that is opposite to the arm 121 is the same or substantially the same, within manufacturing tolerances, as the distance of the barb 231 from an end of the contact 200 that is opposite to the arm 221.

Figure 1C:
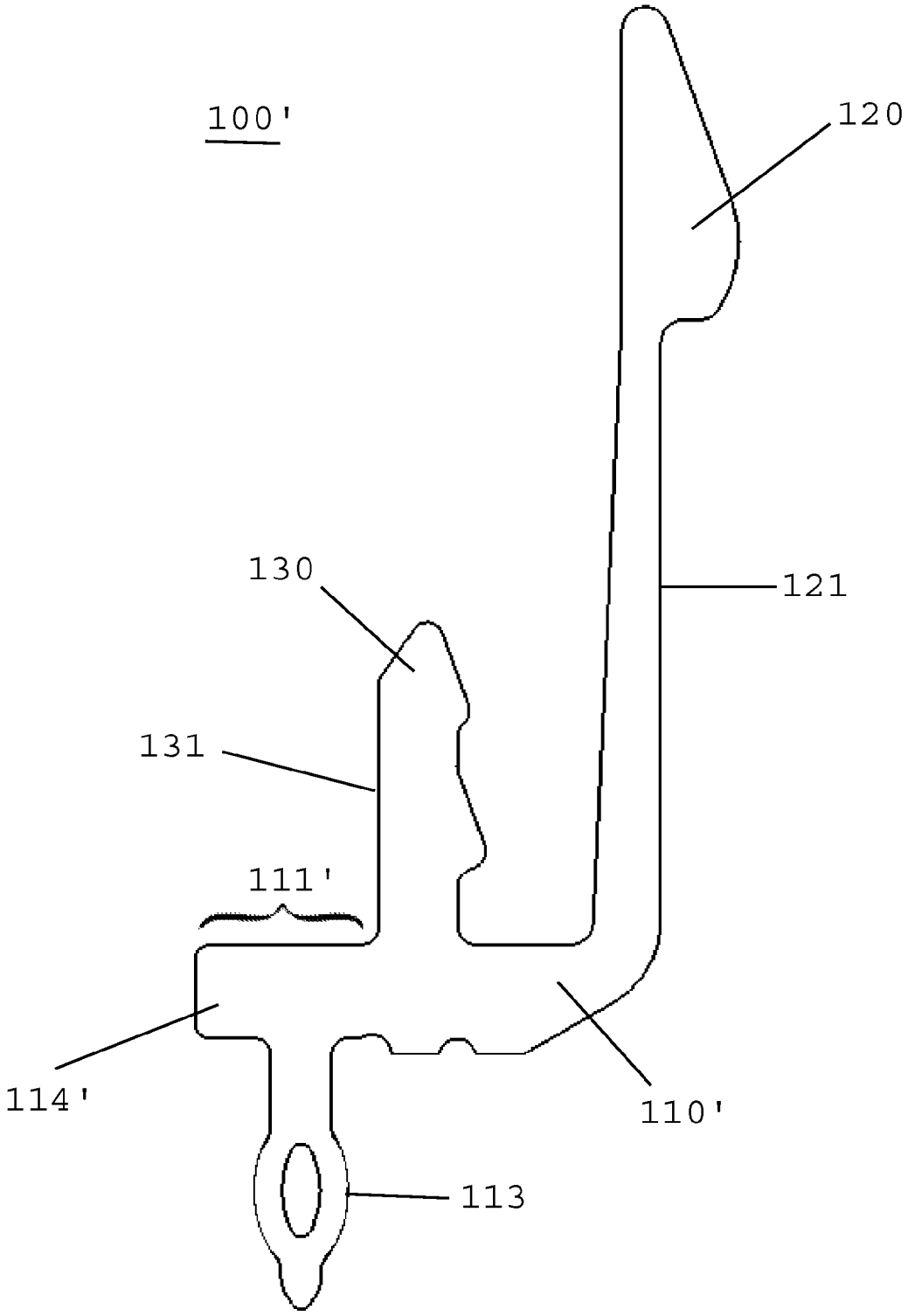
FIG. 1C is view of a contact with a shortened stub in accordance with a preferred embodiment of the present invention.

FIG. 1C is view of a contact 100' with a shortened stub 114' in accordance with a preferred embodiment of the present invention. As shown in FIG. 1C, the contact 100' preferably includes the same leg 113, tip 130, barb 131, contact section 120, and arm 121 as the contact 100 of FIG. 1A. Accordingly, further discussion of these elements will be omitted.

However, as shown in FIG. 1C, contact 100' includes a base section 110' with a shortened tail 111'. The shortened tail 111' includes a shortened stub 114' to mechanically support the contact 100' in a connector, for example, the connector 300 shown in FIGS. 2A-4. That is, the shortened stub 114' of the contact 100', as shown in FIG. 1C, extends a smaller distance than the stub 114 of the contact 100, as shown in FIG. 1A. Thus, the tail 111' of contact 100' preferably has a length that is less than the length of both the tail 111 of contact 100 and the tail 211 of contact 200. That is, the distance of the barb 131 from an end of the contact 100' that is opposite to the arm 121 is preferably less than the distance of the barb 131 from an end of the contact 100 that is opposite to the arm 121 and the distance of the barb 231 from an end of the contact 200 that is opposite to the arm 221. The longer tails 111 and 211 of contacts 100 and 200 provide improved support when the legs 113 and 213 are press-fit into corresponding mounting holes in a substrate.

Figure 2A:
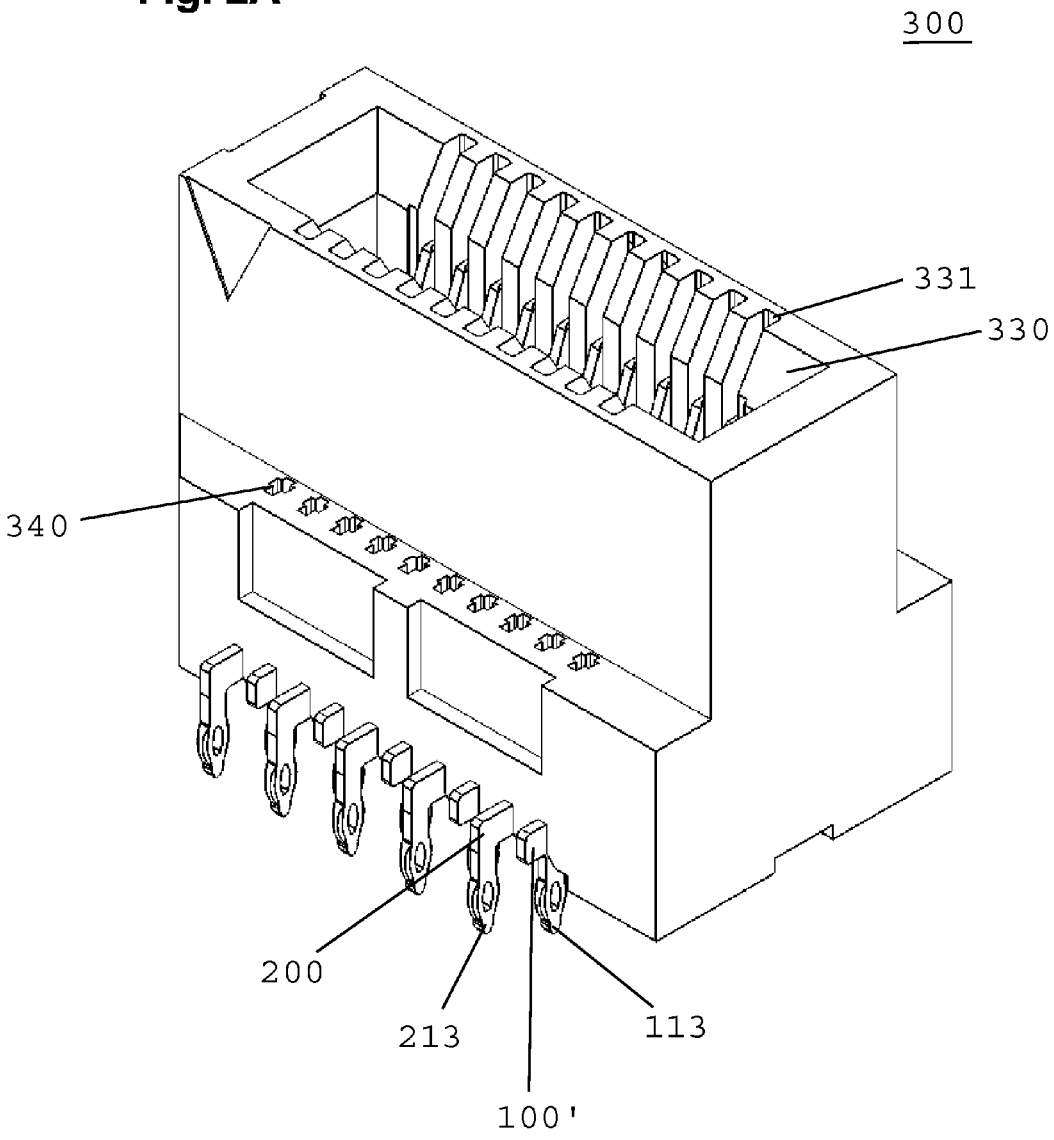
FIG. 2A is a top perspective view of a connector in accordance with a preferred embodiment of the present invention.
Figure 2B:
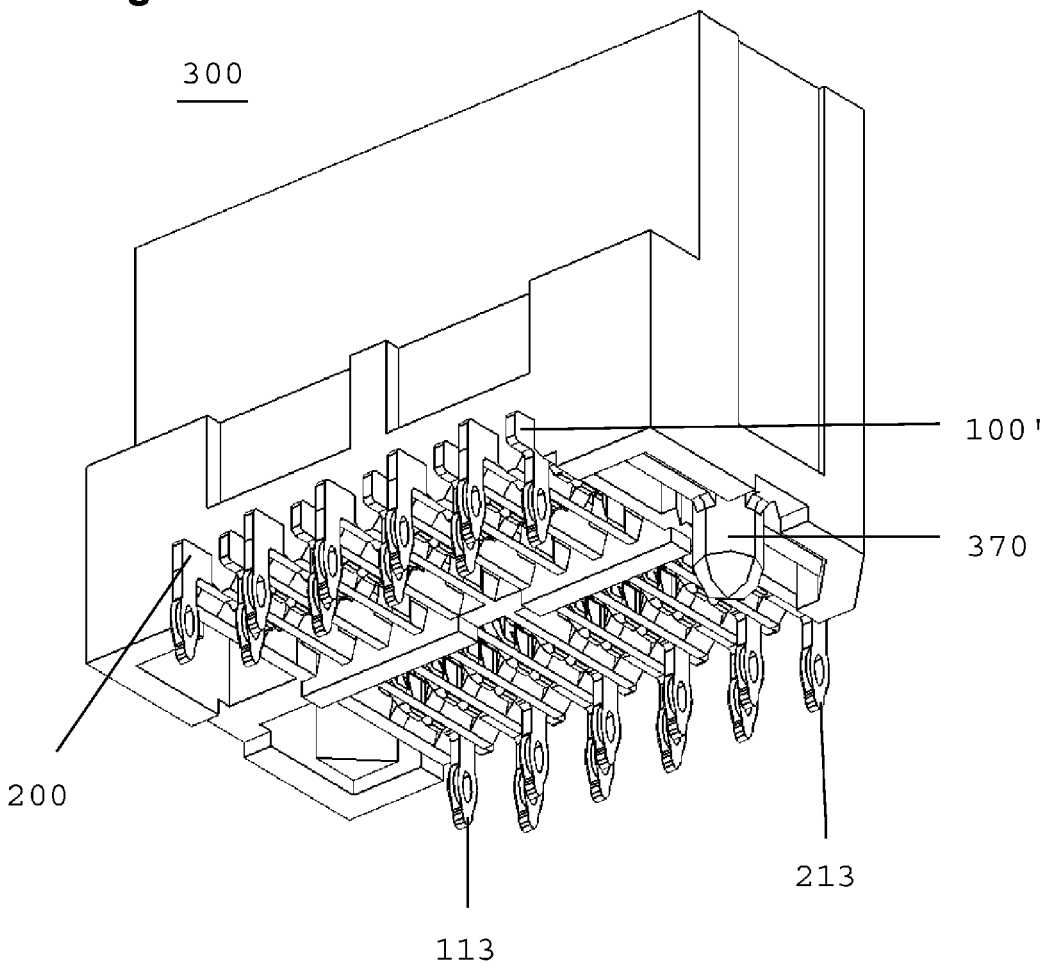
FIG. 2B is a bottom perspective view of the connector of FIG. 2A.
Figure 3:
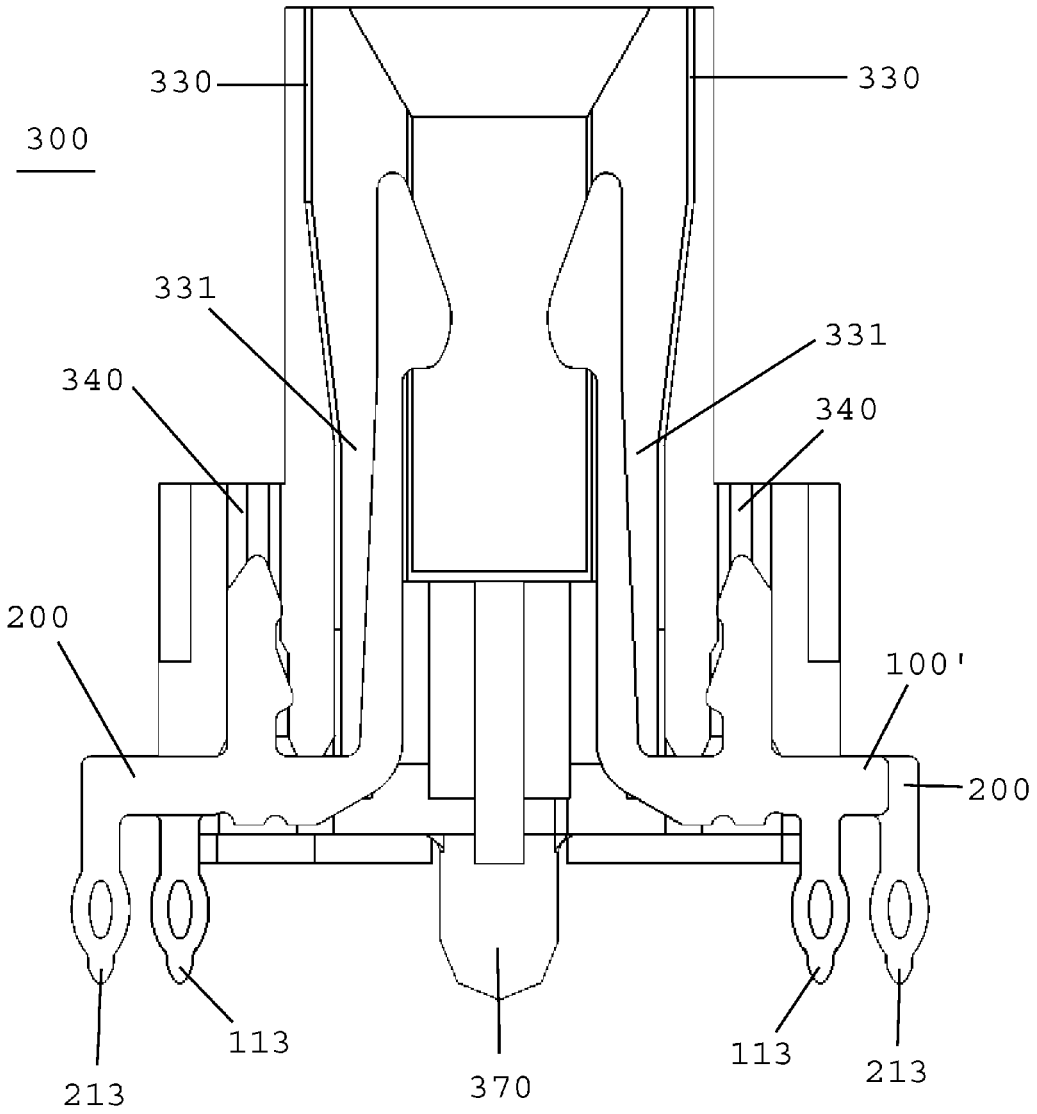
FIG. 3 is a cross-sectional view of the connector of FIG. 2A.
Figure 4:
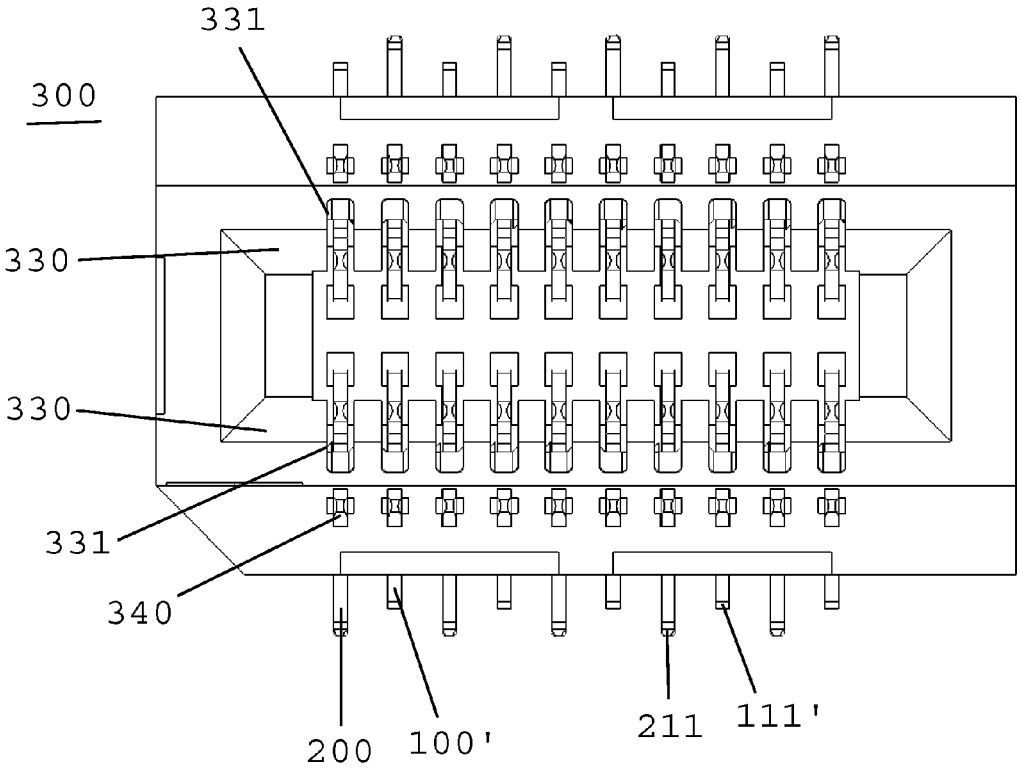
FIG. 4 is a top view of the connector of FIG. 2A.

FIGS. 2A to 4 show a connector 300 in accordance with a preferred embodiment of the present invention. FIG. 2A is a top perspective view of the connector 300. FIG. 2B is a bottom perspective view of the connector 300. FIG. 3 is a cross-sectional view of the connector 300. FIG. 4 is a top view of the connector 300.

As shown in FIGS. 2A to 4, the connector 300 preferably includes both contacts 100' and 200. According to a preferred embodiment, the contacts 100' and 200 are alternated, such that the legs 113 of the contacts 100' and the legs 213 of the contacts 200 are arranged in a staggered manner. Staggering the legs 113 and 213 improves an impedance profile and reduces a propagation delay of the connector 300, specifically by improving the signal response of the contacts 100' and 200 by increasing a minimum impedance of the contacts 100' and 200. In particular, the impedance may be improved, for example, from about 62Ω to about 75Ω by staggering the legs 113 and 213. Further, the propagation delay may be improved, for example, to be less than about 2.5 picoseconds. Accordingly, signal interference between adjacent contacts 100' and 200 is reduced by staggering the legs 113 and 213. Additionally, staggering the legs 113 and 213 enables an increased density of contacts 100' and 200, since the staggered legs 113 and 213 allows for staggered mounting holes in a substrate upon which the connector 300 is mounted. The distance between two of the contacts 100' and 200 that define a differential pair may be adjusted to obtain a desired impedance profile and propagation delay.

Furthermore, as shown in FIG. 4, the ends of the shortened tails 111' of the contacts 100' and the ends of the tails 211 of the contacts 200 are preferably arranged in a staggered manner, due to the alternating arrangement of the contacts 100' and 200. Staggering the ends of the tails 111' and 211 improves discontinuities in the signal response of the contacts 100 and 200. Accordingly, signal interference between adjacent contacts 100' and 200 is reduced by staggering the ends of the tails 111' and 211.

Slots 331 along inner walls 330 of the connector 300 receive the arms 121 and 221 of the contacts 100' and 200. Further, the barb holes 340 of the connector 300 receive the barbs 131 and 231 of contacts 100' and 200. When one of the barbs 131 and 231 is inserted into one of the barb holes 340, the barb hole 340 helps to secure and position the respective one of the contacts 100' and 200 within the connector 300. Each of the barb holes 340 may pass fully through the connector 300, in order to improve the strength of a mold core pin used during the manufacturing process of the connector 300. Each of the barb holes 340 preferably includes a stepped portion to engage with ridges arranged on one of the barbs 131 and 231. As described above, sharpening or tapering the tips 130 and 230 of the contacts 100' and 200 improves discontinuities in the signal response of the connector 300.

As seen in FIGS. 2B and 3, the connector 300 preferably includes at least one alignment pin 370. The alignment pin 370 is used to guide the connector 300 to the proper location and proper orientation on a substrate at which the connector 300 is to be attached.

Figure 5A:
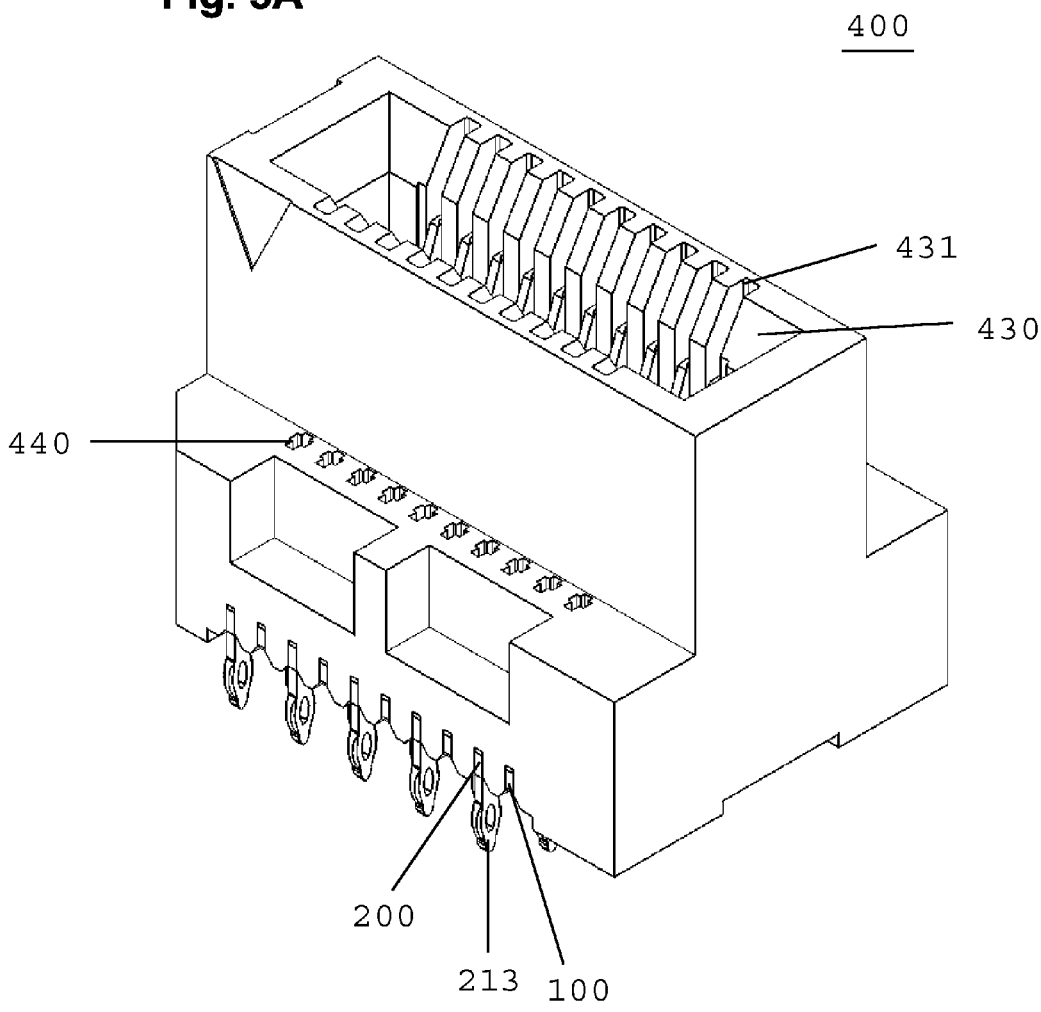
FIG. 5A is a top perspective view of a connector in accordance with a preferred embodiment of the present invention.
Figure 5B:
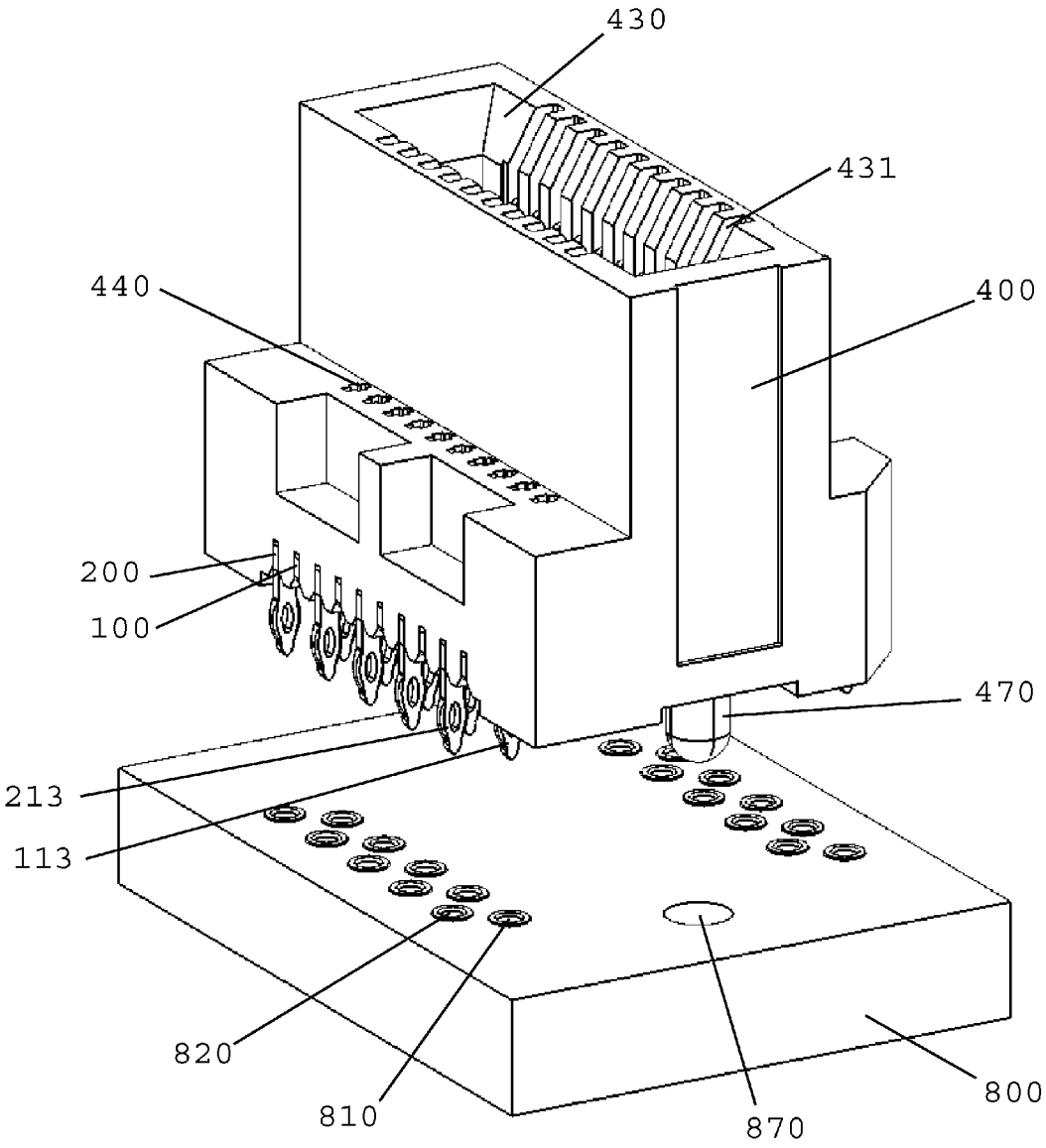
FIG. 5B is a top perspective view of the connector of FIG. 5A before being engaged with a substrate.
Figure 6A:
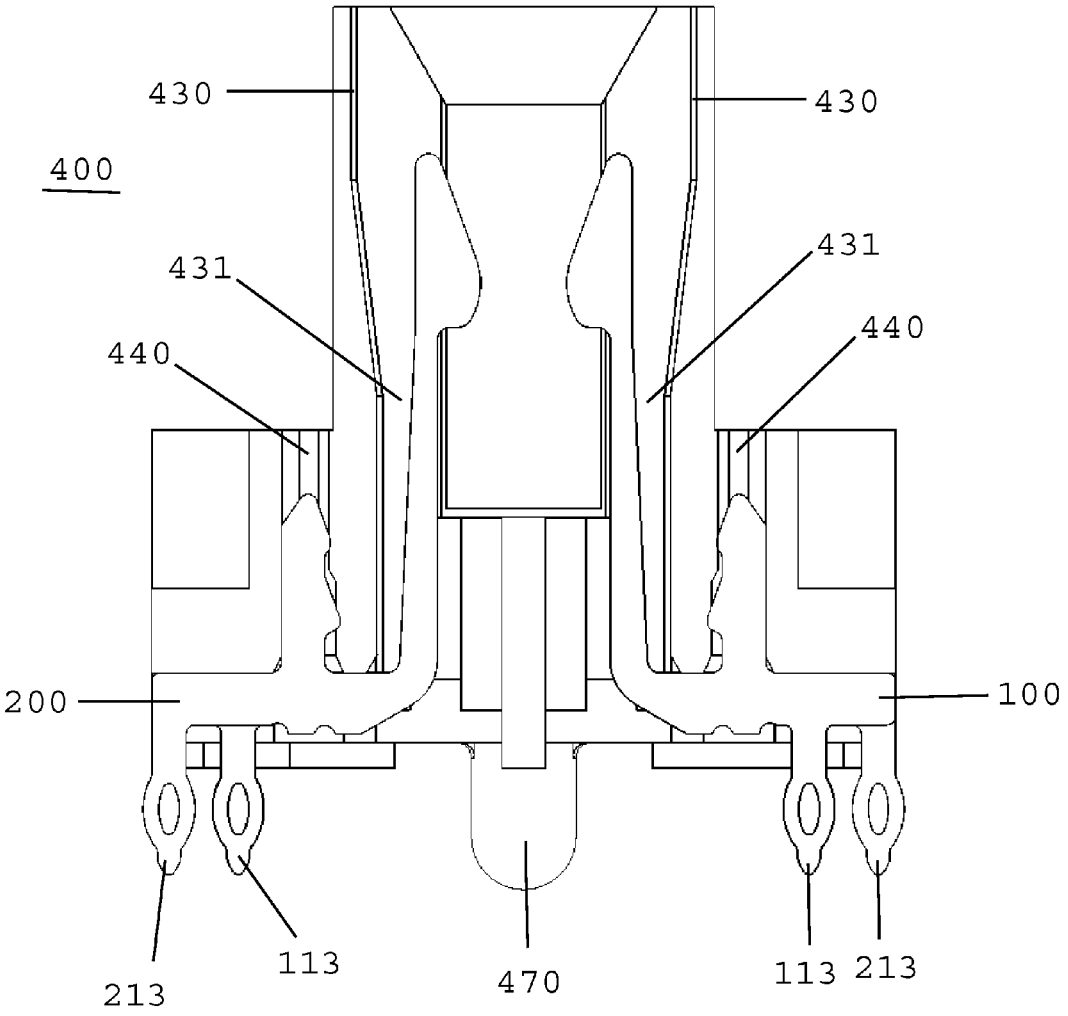
FIG. 6A is a cross-sectional view of the connector of FIG. 5A.
Figure 6B:
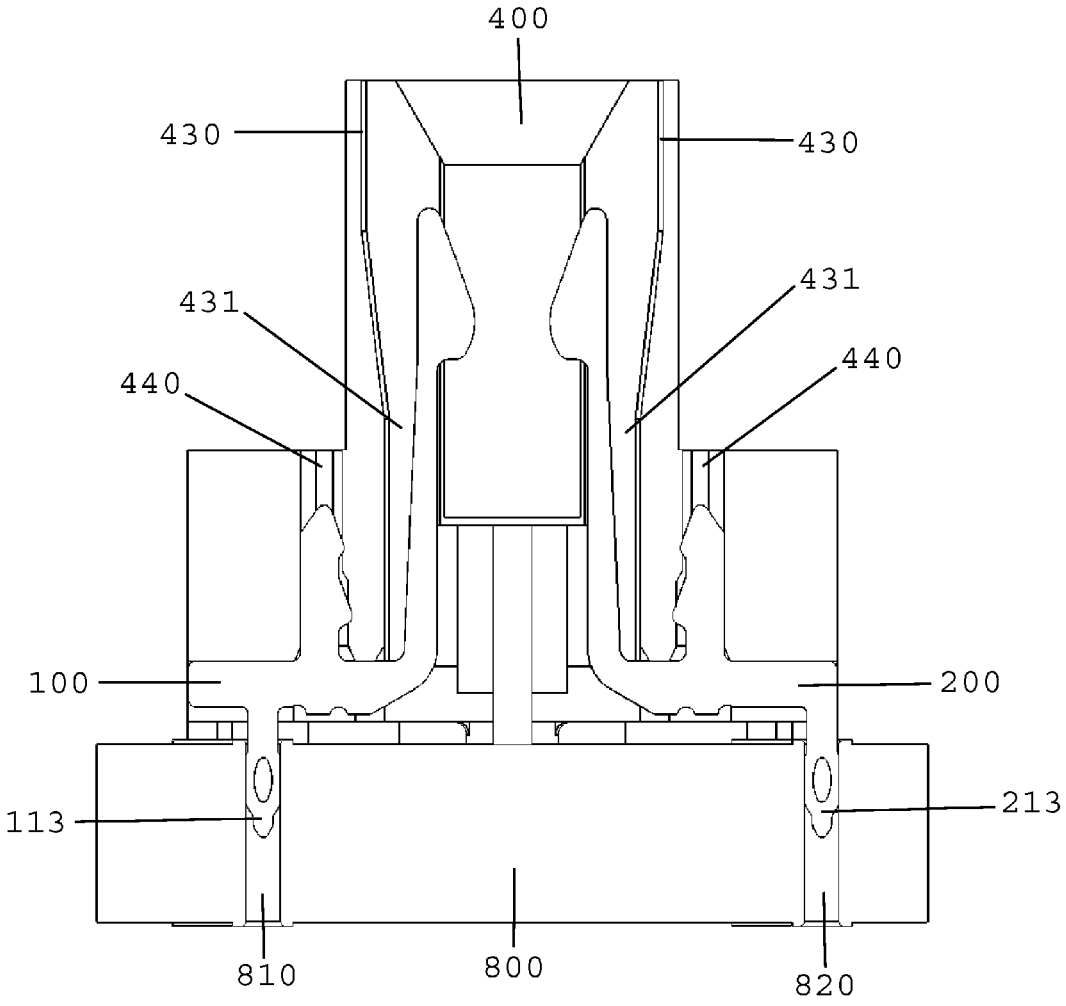
FIG. 6B is a cross-sectional view of the connector of FIG. 5A engaged with a substrate.

FIGS. 5A to 6B show a connector 400 in accordance with a preferred embodiment of the present invention. FIG. 5A is a top perspective view of the connector 400, and FIG. 5B is a top perspective view of the connector 400 before being engaged with substrate 800. Substrate 800 is typically a printed circuit board FIG. 6A is a cross-sectional view of the connector 400, and FIG. 6B is a cross-sectional view of the connector 400 engaged with the substrate 800.

As shown in FIGS. 5A to 6B, the connector 400 preferably includes both contacts 100 and 200. According to a preferred embodiment, the contacts 100 and 200 are alternated, such that the legs 113 of the contacts 100 and the legs 213 of the contacts 200 are arranged in a staggered manner, as shown in FIGS. 5B and 6A. Staggering the legs 113 and 213 improves an impedance profile and reduces a propagation delay of the connector 400, particularly by improving the signal response of the contacts 100 and 200 by increasing a minimum impedance of the contacts 100 and 200. For example, impedance may be improved from about 62Ω to about 75Ω (within about ±5%) for a single-ended implementation, and propagation delay may be maintained at or below about 2 picoseconds. Additionally, signal interference between adjacent contacts 100, 200 is reduced by staggering the legs 113 and 213. The distance between two of the contacts 100 and 200 that define a differential pair may be adjusted to obtain a desired impedance profile and propagation delay.

Furthermore, staggering the legs 113 and 213 enables an increased density of contacts 100 and 200, since the staggered legs 113 and 213 allows for staggered connections in the substrate 800 upon which the connector 400 is mounted. As shown in FIGS. 5B and 6B, the substrate 800 includes inner vias 810 and outer vias 820 that are arranged respectively to engage with the legs 113 and 213. Staggering of the inner vias 810 and the outer vias 820 in the substrate 800 allows for closer coupling of differential signal pairs of the contacts 100 and 200. This arrangement also allows the inner vias 810 and the outer vias 820 to have diameters greater than a width of the corresponding signal traces (not shown) on the substrate 800. Accordingly, large diameters of the inner vias 810 and the outer vias 820 allow the legs 113 and 213 to have a large size, thereby providing greater mechanical stability for the contacts 100 and 200 when inserted into the substrate 800. Thus, the substrate 800 may be easily manufactured, and the connector 400 may be easily and securely mounted to the substrate 800 while reducing the risk of one of the legs 113 and 213 buckling during insertion into the inner vias 810 and the outer vias 820. Further, staggering the inner vias 810, the outer vias 820, and the legs 113 and 213 allows increased density of signal traces on and in the substrate 800 and allows improved signal integrity by decreasing the coupling between adjacent vias.

Slots 431 along inner walls 430 of the connector 400 receive the arms 121 and 221 of the contacts 100 and 200. Further, the barb holes 440 of the connector 400 receive the barbs 131 and 231 of contacts 100 and 200. When one of the barbs 131 and 231 is inserted into one of the barb holes 440, the barb hole 340 helps to secure and position the respective one of the contacts 100, 200 within the connector 400. Each of the barb holes 440 may pass fully though the connector 400, in order to improve the strength of a mold core pin used during the manufacturing process of the connector 400. Each of the barb holes 440 preferably includes a stepped portion to engage with ridges arranged on one of the barbs 131 and 231. As described above, sharpening or tapering the tips 130 and 230 of the contacts 100 and 200 improves discontinuities in the signal response of the connector 400.

As seen in FIGS. 5B and 6A, the connector 400 preferably includes at least one alignment pin 470. The alignment pin 470 is used to guide the connector 400 to the proper location and proper orientation on the substrate 800 by engaging with an alignment hole 870 of the substrate 800.

As compared with connector 300, connector 400 includes a wider connector body that extends to the end of each of the tails 111 and 211. This arrangement provides a more secure mechanical connection between the contacts 100 and 200 and the connector 400 than between the contacts 100' and 200 and the connector 300. However, the connector 400 is more susceptible to signal integrity issues such as reflection and capacitance between the contacts 100 and 200, due to the tail 111 of contact 100 having a length that is the same or substantially the same, within manufacturing tolerances, as the tail 211 of contact 200. In particular, the tails 111 and 211 having lengths that are the same or substantially the same increases the capacitance between adjacent tails 111 and 211, causing the tails 111 and 211 to become capacitive stubs.

According to a preferred embodiment, the wider connector body of the connector 400 can be adapted to the connector 300, such that the connector 300 extends to the ends of the tails 111' or the ends of the tails 211, thereby providing a more secure mechanical connection between the contacts 100' and 200 and the connector 300.

Figure 7:
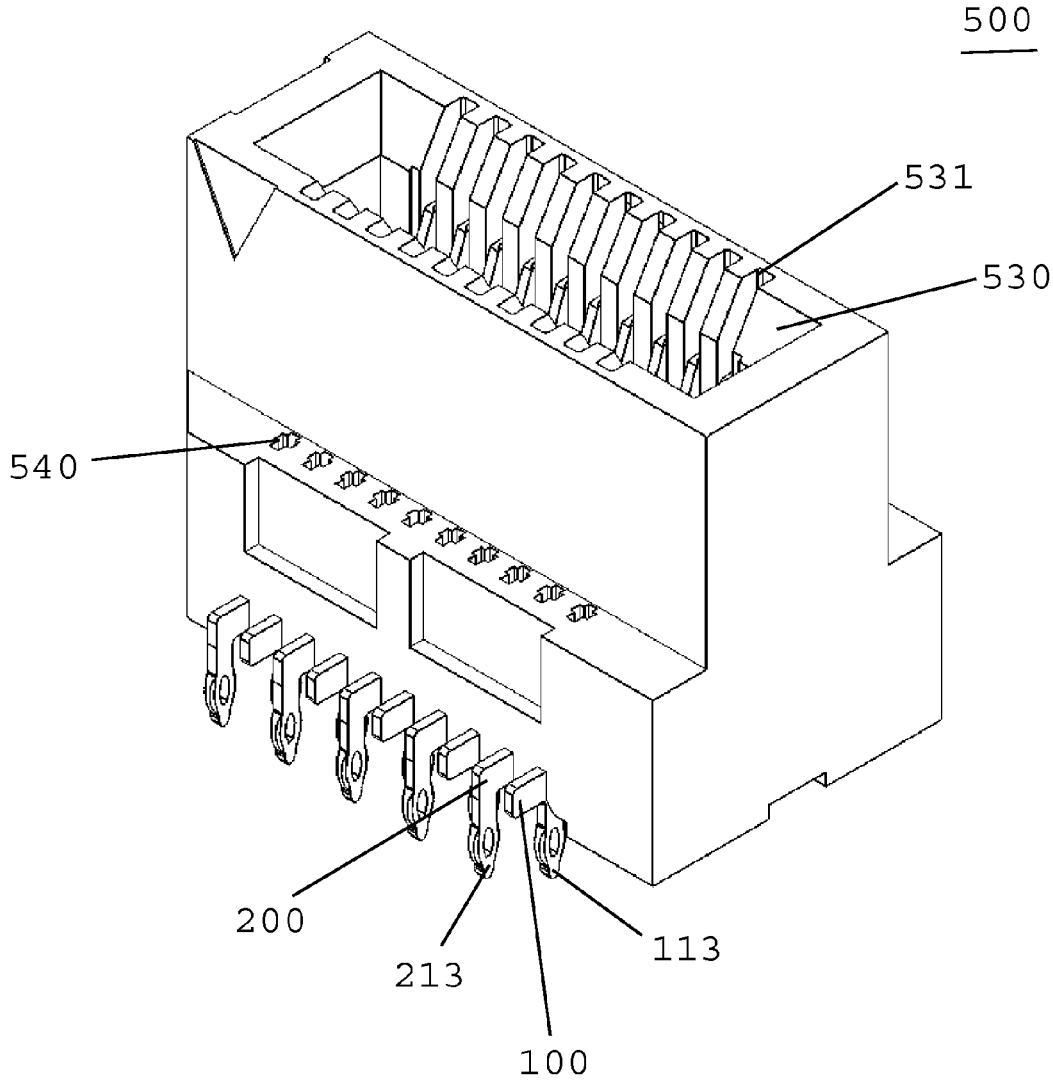
FIG. 7 is a top perspective view of a connector in accordance with a preferred embodiment of the present invention.
Figure 8A:
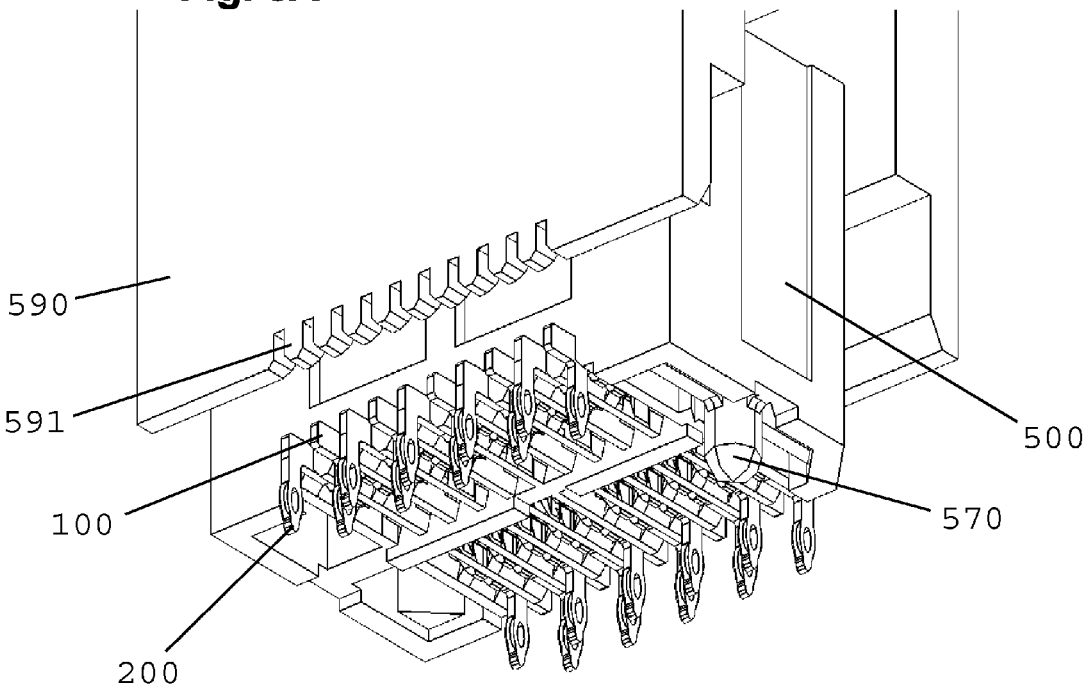
FIG. 8A is a top perspective view of the connector of FIG. 7 before being engaged with an assembly tool.
Figure 8B:
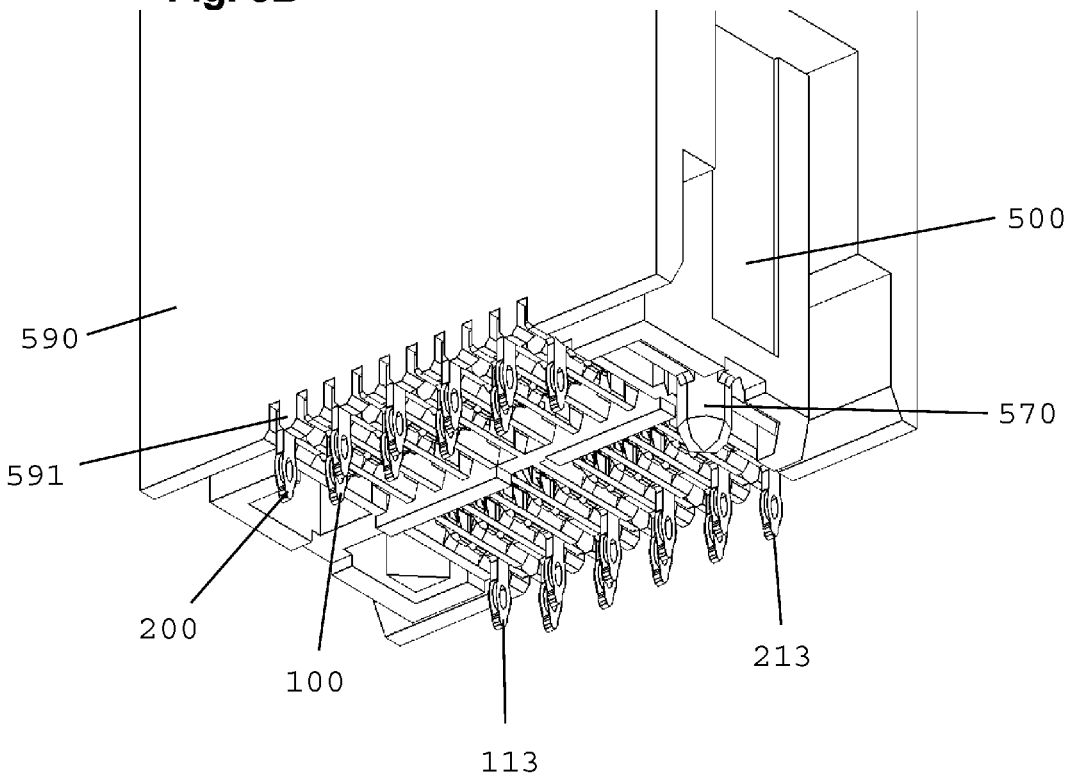
FIG. 8B is a top perspective view of the connector of FIG. 7 engaged with the assembly tool.
Figure 9:
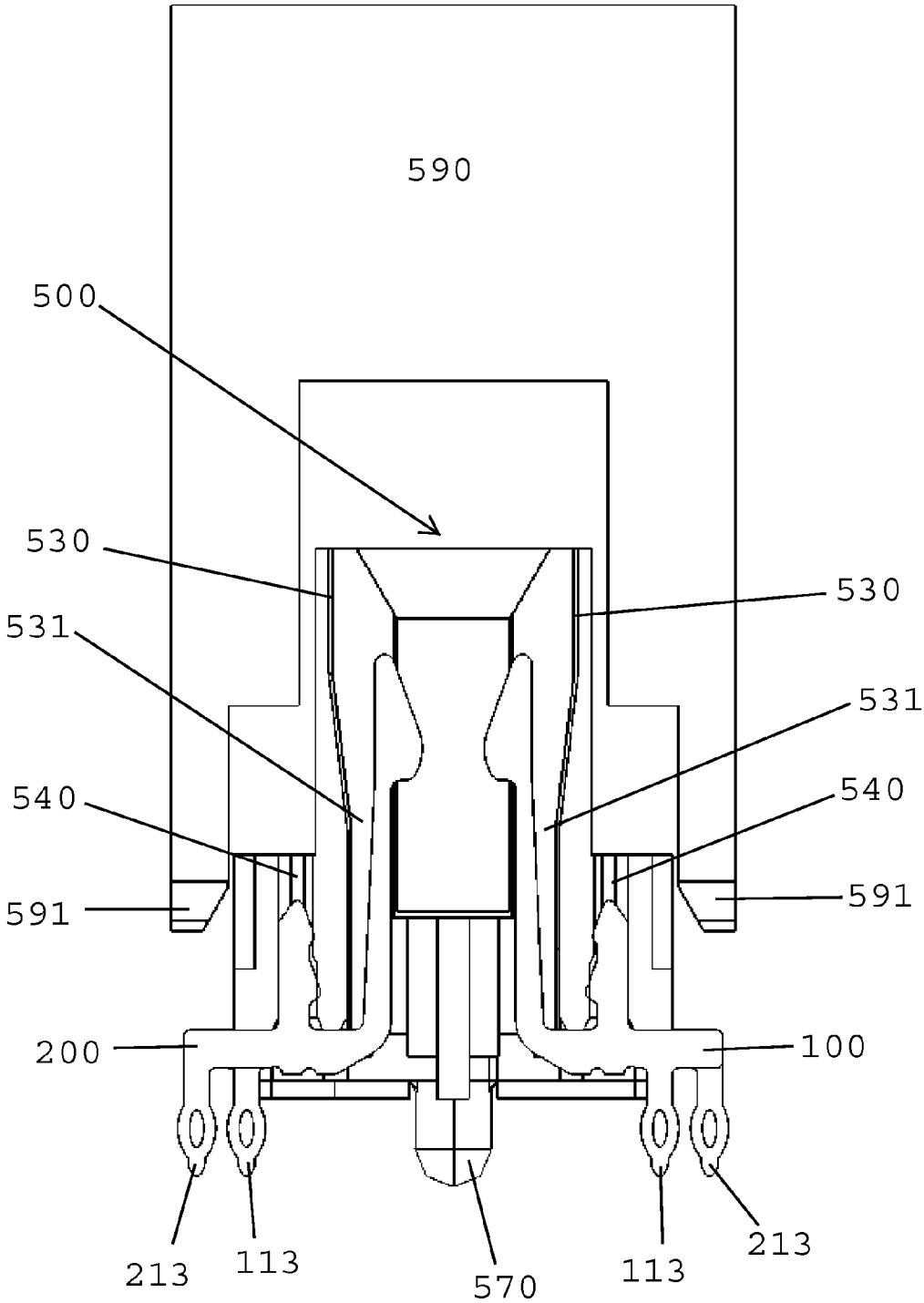
FIG. 9 is a cross-sectional view of the connector of FIG. 7 before being engaged with the assembly tool.

FIGS. 7 to 9 show a connector 500 in accordance with another preferred embodiment of the present invention. FIG. 7 is a top perspective view of the connector 500. FIG. 8A is a top perspective view of the connector 500 before being engaged with an assembly tool 590. FIG. 8B is a top perspective view of the connector 500 engaged with the assembly tool 590. FIG. 9 is a cross-sectional view of the connector 500 before being engaged with the assembly tool 590.

As shown in FIGS. 7 to 9, the connector 500 preferably includes both contacts 100 and 200. Connector 500 preferably includes a similar construction as connector 400, including inner walls 530, slots 531, barb holes 540, and alignment pin 570 that are similar to inner walls 430, slots 431, barb holes 440, and alignment pin 470. However, as compared with connector 400, connector 500 includes a narrower connector body that does not extend to the end of each of the tails 111 and 211 of contacts 100 and 200.

As shown in FIGS. 8*a* to 9, the assembly tool 590 engages with the connector 500. Preferably, the assembly tool 590 includes teeth 591 that are arranged to fit between adjacent tails 111 and 211 of contacts 100 and 200. Accordingly, the teeth 591 help to secure and position the assembly tool 590, as well as maintain spacing and positioning of the tails 111 and 211 of contacts 100 and 200, when the assembly tool 590 is used to press-fit the legs 113 and 213 of the contacts 100 and 200 to corresponding mounting holes in a substrate. The teeth 591 of the assembly tool 590 also transfer force directly to the contacts 100 and 200 during press-fitting of the connector 500, thereby providing a more direct transfer of force to the legs 113 and 213 of the contacts 100 and 200 as compared to force applied to an upper surface of the connector 500.

According to a preferred embodiment, the assembly tool 590 can be adapted to the connector 300, such that the one or more teeth 591 of the assembly tool 590 are arranged to fit between adjacent tails 111' and 211 of contacts 100' and 200. According to a preferred embodiment, the assembly tool 590 can be adapted to the connector 400, such that no teeth 591 of the assembly tool 590 are needed and such that the assembly tool 590 can be used without have to align the teeth 590 with adjacent tails 111 and 211 of contacts 100 and 200.

Figure 10:
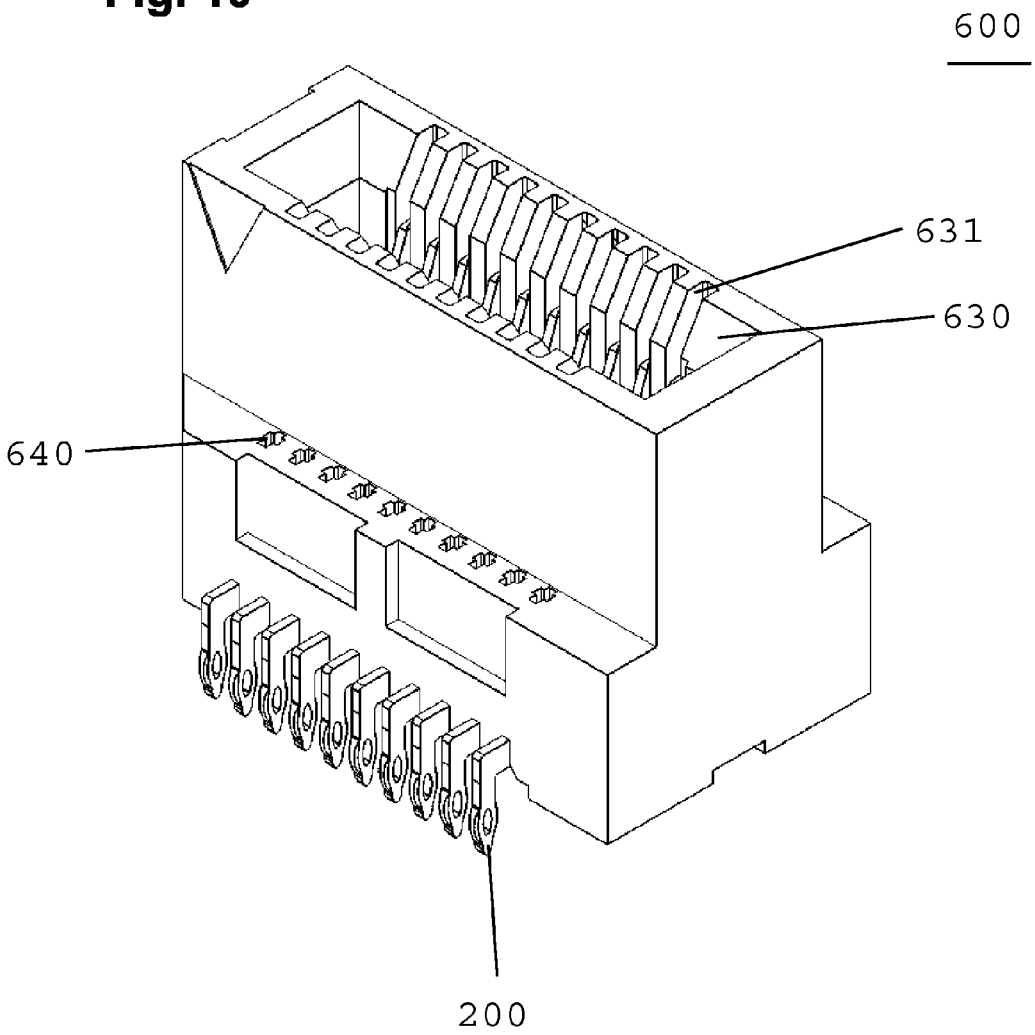
FIG. 10 is a top perspective view of a comparative example of a connector.

FIG. 10 is a top perspective view of a comparative example of a connector 600.

As shown in FIG. 10, connector 600 includes a plurality of contacts 200. Although the connector 600 may be more susceptible to signal interference in the contacts 200, due to the alignment of each of the legs 213 and tails 211, the use of only one arrangement of contacts 200 provides a connector 600 that is easier to manufacture and install. Furthermore, an assembly tool, such as assembly tool 590 as shown in FIGS. 8A to 9, may be used with connector 600 to press-fit the legs 213 of the contacts 200 to corresponding mounting holes in a substrate.

Figure 11A:
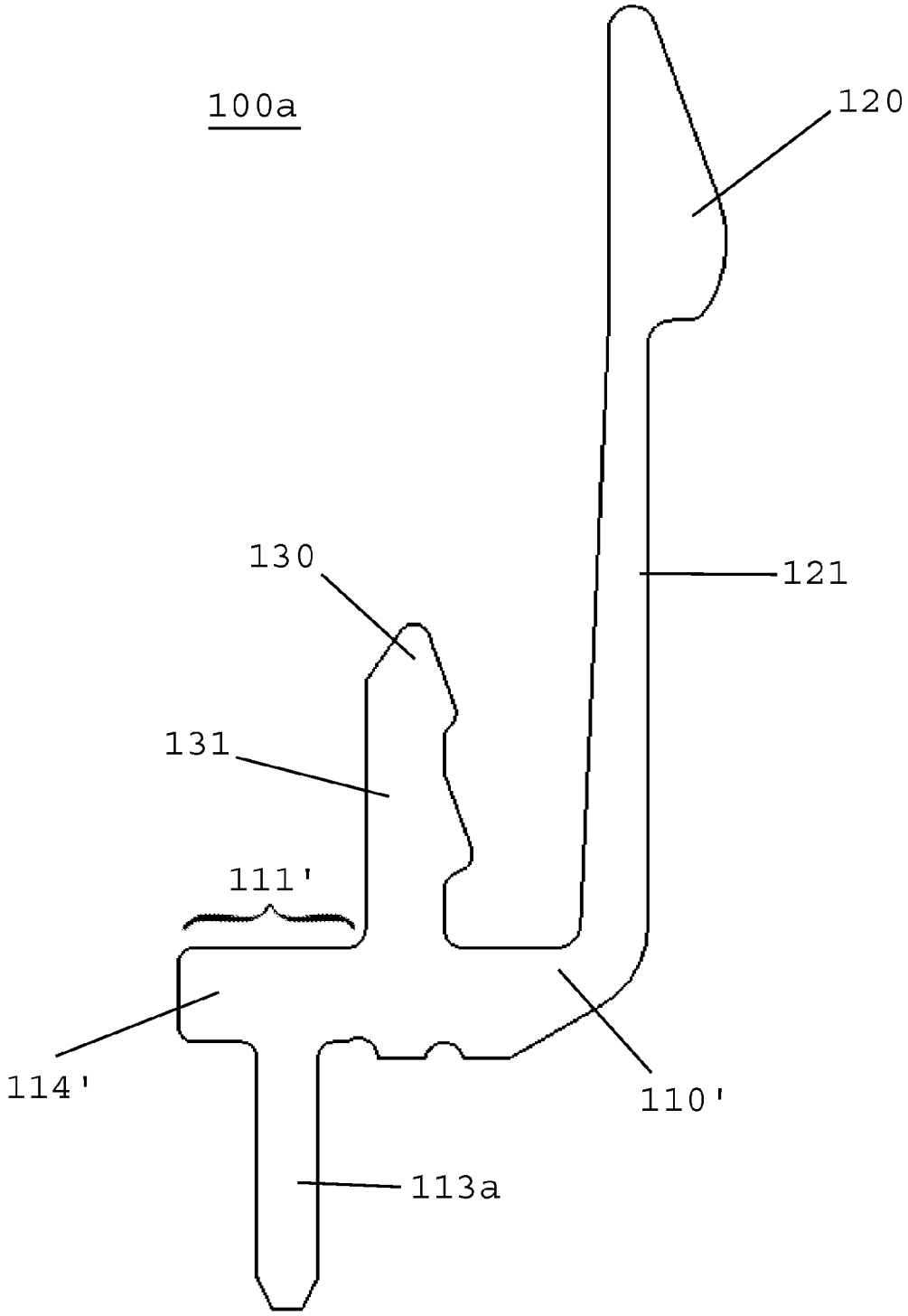
FIG. 11A is view of a contact with a straight leg and with a shortened stub in accordance with a preferred embodiment of the present invention.

FIG. 11A is view of a contact 100*a* with a straight leg 113*a* and a shortened stub 114' in accordance with a preferred embodiment of the present invention. As shown in FIG. 11A, the contact 100*a* preferably includes the same base section 110' with a shortened tail 111' including a shortened stub 114', tip 130, barb 131, contact section 120, and arm 121 as the contact 100' of FIG. 1C. Accordingly, further discussion of these elements will be omitted.

Figure 11B:
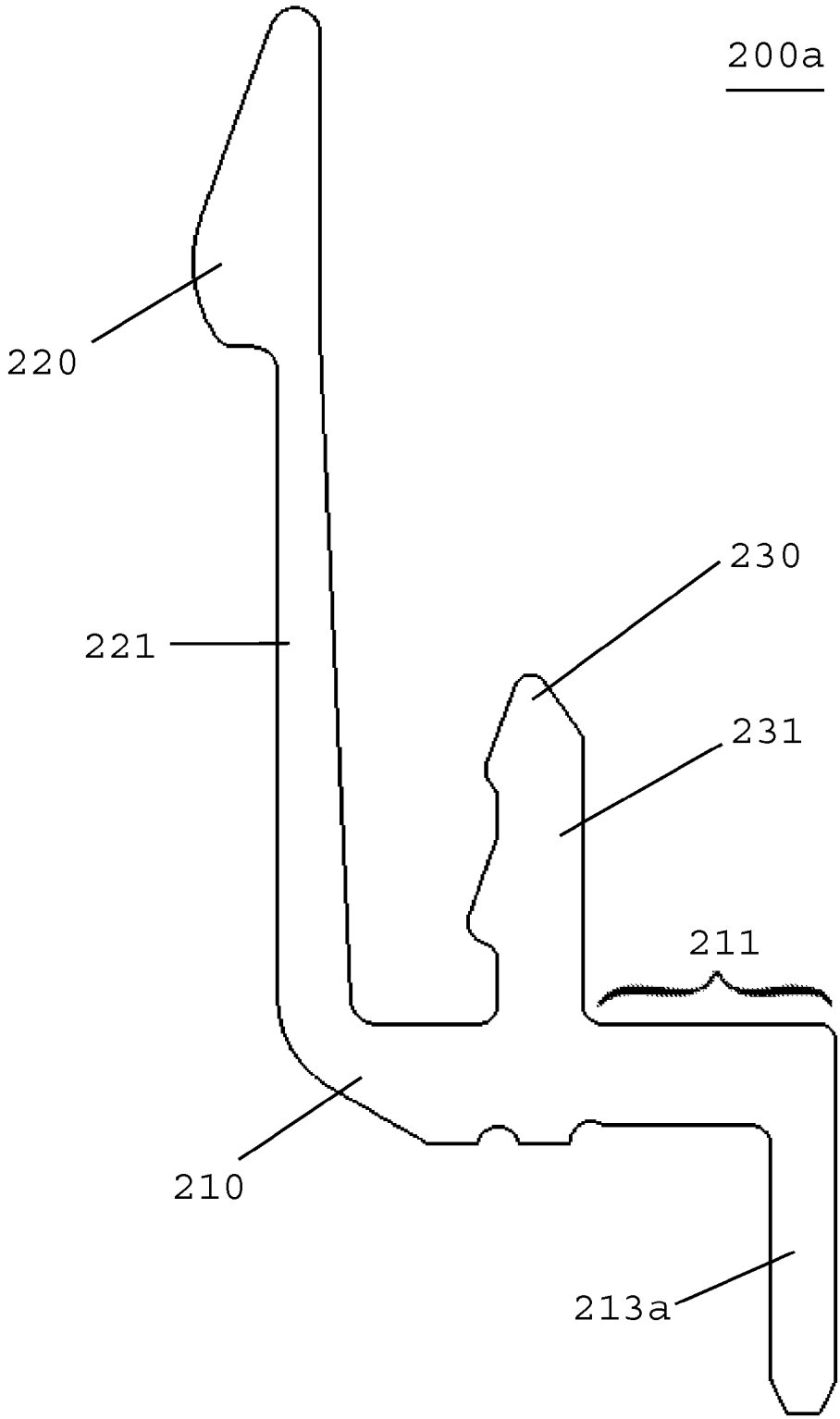
FIG. 11B is a view of a contact with a straight leg and without a stub in accordance with a preferred embodiment of the present invention.

FIG. 11B is a view of a contact 200*a* with a straight leg 213*a* in accordance with a preferred embodiment of the present invention. As shown in FIG. 11B, contact 200*a* preferably includes the same base section 210 with a tail 211, tip 230, barb 231, contact section 220, and arm 221 as the contact 200 of FIG. 1B. The tail 211 extends from the barb 231 to an end of the contact 200 that is opposite to the arm 221. Accordingly, further discussion of these elements will be omitted.

Figure 12:
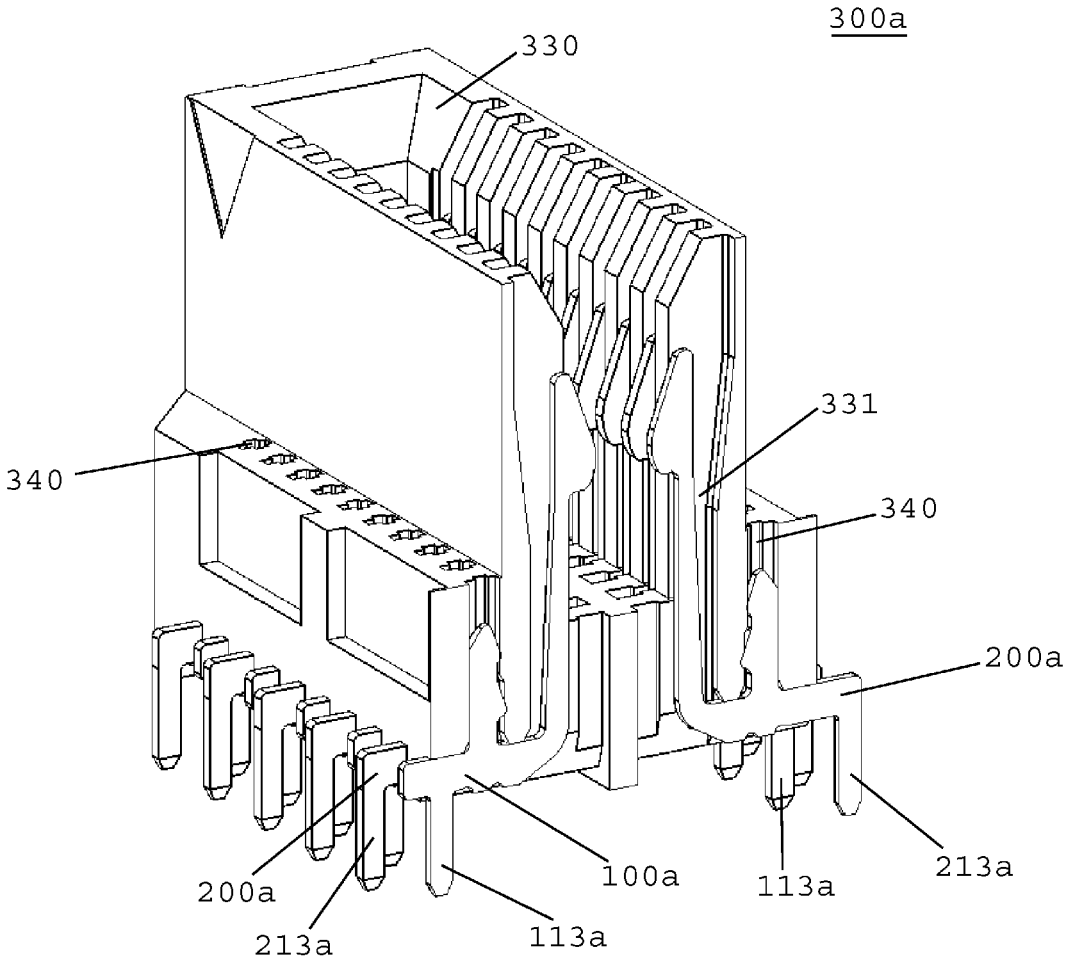
FIG. 12 is a top perspective cross-sectional view of a connector in accordance with a preferred embodiment of the present invention.
Figure 13:
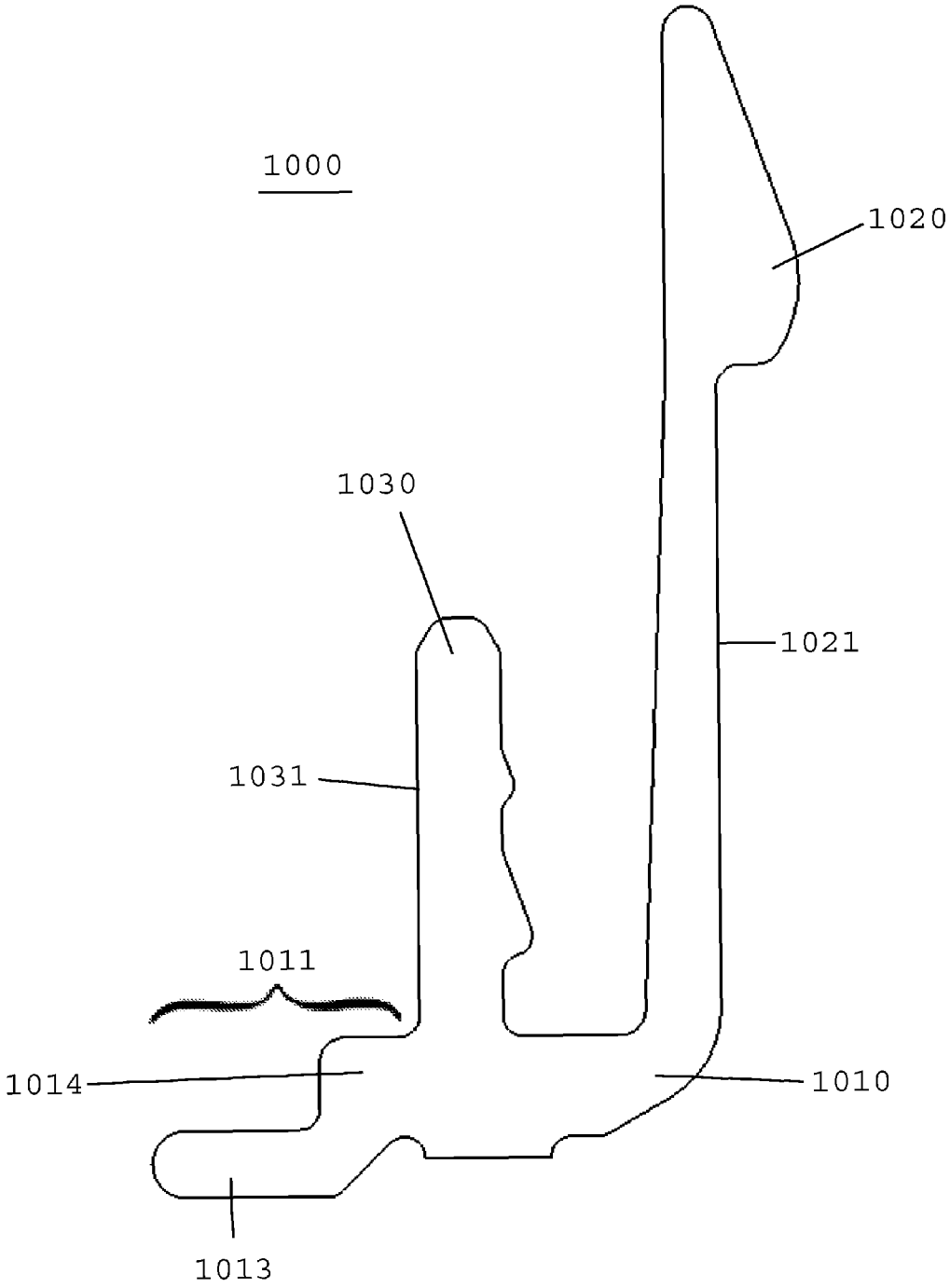
Fig. 13 Prior Art
FIG. 13 is a side view of a known contact.
Figure 14A:
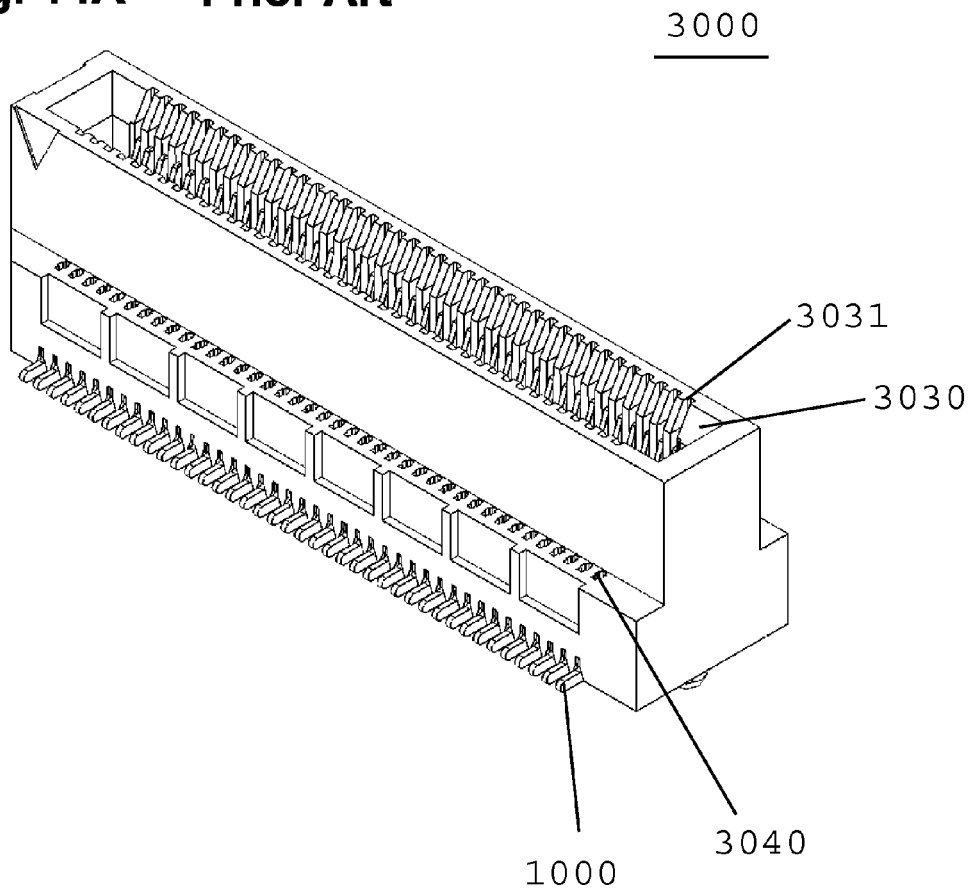
Fig. 14A Prior Art
FIG. 14A is a top perspective view of a known connector.
Figure 14B:
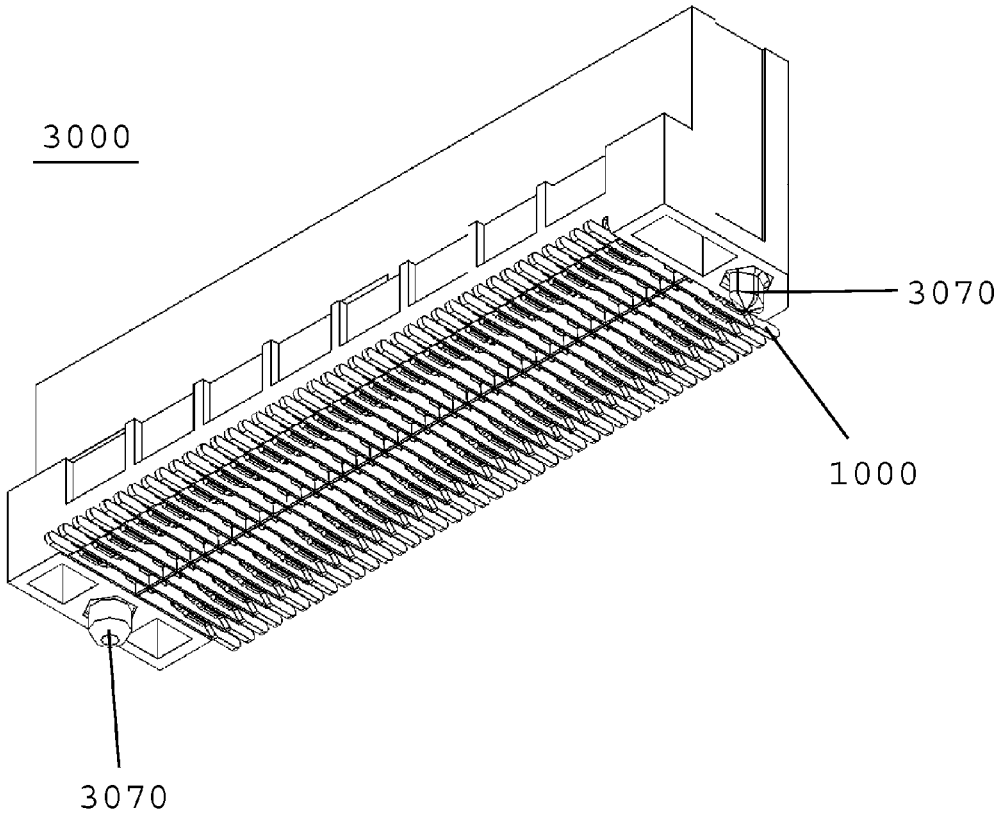
Fig. 14B Prior Art
FIG. 14B is a bottom perspective view of the known connector of FIG. 14A.
Figure 15:
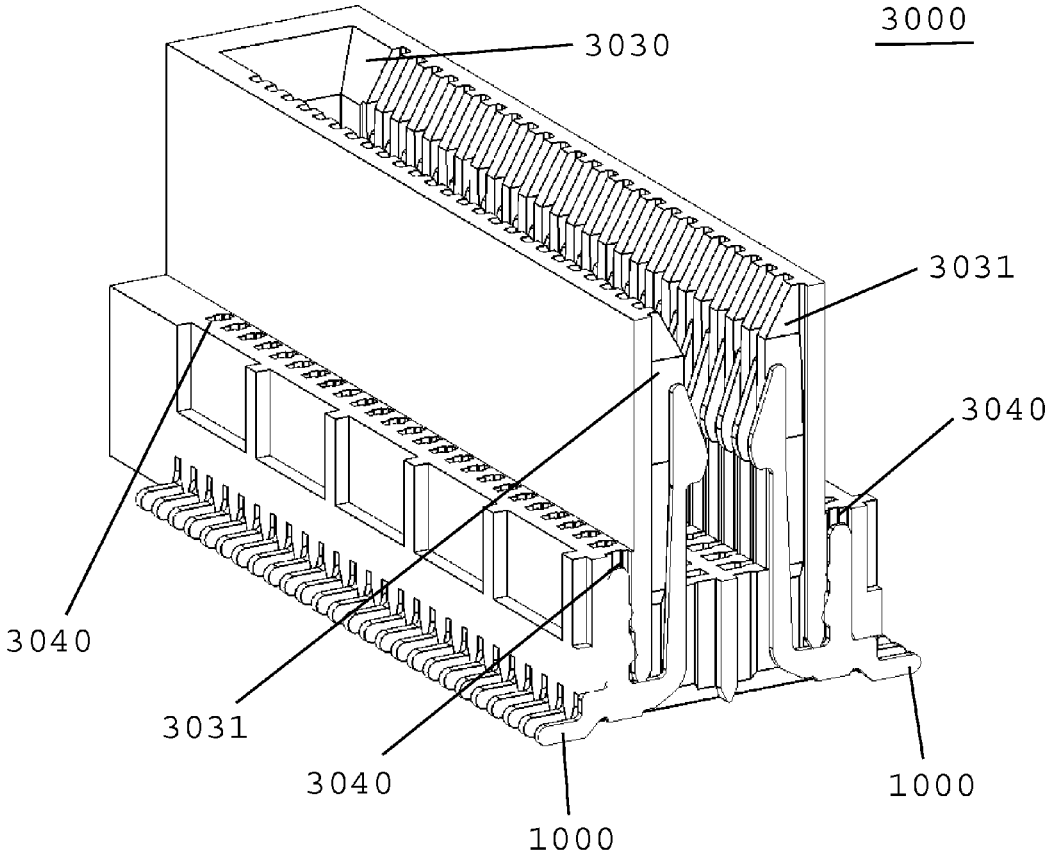
Fig. 15 Prior Art
FIG. 15 is a top perspective cross-sectional view of the known connector of FIG. 14A.

FIG. 12 is a top perspective cross-sectional view of a connector 300*a* in accordance with a preferred embodiment of the present invention. As shown in FIG. 12, connector 300*a* preferably has substantially the same structure as the connector 300 shown in FIGS. 2A to 4. However, as shown in FIG. 12, the connector 300*a* preferably includes both contacts 100*a* and 200*a*. According to a preferred embodiment of the present invention, the contacts 100*a* and 200*a* are alternated in the connector 300*a*, such that the legs 113*a* of the contacts 100*a* and the legs 213*a* of the contacts 200*a* are arranged in a staggered manner.

The contacts 100*a* and 200*a* as shown in FIGS. 11A, 11B, and 12 provide straight legs 113*a* and 213*a* as compared to the "eye-of-the-needle" configuration of the legs 113 and 213 described above with respect to FIGS. 1A to 1C. Accordingly, the contacts 100*a* and 200*a* may be used, for example, in applications where it is undesirable to engage a connector to a substrate (e.g., printed circuit board) by a press-fit connection or to reduce manufacturing costs while maintaining the other advantages provided by the preferred embodiments of the present invention.

The legs 113 and 213 of the contacts 100, 100', and 200 are described above with respect to an "eye-of-the-needle" configuration, and the legs 113*a* and 213*a* of the contacts 100*a* and 200*a* are described above with respect to a straight leg configuration. However, the arrangement of the legs 113, 213, 113*a*, and 213*a* is not limited to these two configurations. For example, other configurations that may be used with the preferred embodiments of the present invention include a square post, a kinked pin, an action pin, a Winchester C-Press® compliant pin, or any other suitable configuration.

The tips 130 and 230 of the barbs 131 and 231 according to the preferred embodiments of the present invention are preferably sharpened to an approximately 45° angle or less, and more preferably sharpened to an approximately 30° angle or less, for example. Furthermore, the barbs 131 and 231 may be staggered in the connectors 300, 400, 500, 600, and 300*a* according to the preferred embodiments of the present invention in order to further reduce signal interference between the contacts 100, 100', 200, 100*a*, and 200*a*.

The connectors 300, 400, 500, 600, and 300*a* and the assembly tool 590 according to the preferred embodiments of the present invention are preferably made from an insulating material, for example, any plastic, thermoplastic, rubber, or similar non-metallic material. Furthermore, the assembly tool 590 may be made from a wide variety of hard or solid tooling materials including metallic materials, for example, a copper alloy or a steel alloy, and any material that is harder than a material used for the connectors 300, 400, 500, 600, and 300*a*.

In the connectors 300, 400, 500, 600, and 300*a* according to the preferred embodiments of the present invention, only some of the contacts 100, 100', 200, 100*a*, and 200*a* may be staggered. As an example, only certain contacts 100, 100', 200, 100*a*, and 200*a* may be staggered, according to design requirements or specific signal interference concerns. As another example, contacts 100, 100', 200, 100*a*, and 200*a* that carry a signal may be staggered, while contacts 100, 100', 200, 100*a*, and 200*a* that are grounds may not be staggered, or vice-versa. Furthermore, the tails 113 and 113*a* of the contacts 100, 100', and 100*a* may be staggered at various positions along the base sections 110 and 100', for example, to provide three or more rows of tails in the connectors 300, 400, 500, and 600, and 300*a*.

In the connectors 300, 400, 500, and 300*a* according to the preferred embodiments of the present invention, jitter or resonance may arise due to different lengths of electrical paths between the contact sections 120 and 220 and the legs 113, 213, 113*a*, and 213*a*. Accordingly, in order to compensate for this jitter or resonance, the lengths of electrical traces in a substrate (e.g., a printed circuit board) upon which the connectors 300, 400, 500, and 300*a* are mounted may be adjusted so that the overall length of each signal path associated with each of the contacts 100, 100', 200, 100*a*, and 200*a* is the same or substantially the same.

As shown in FIGS. 2A-10 and 12, the connectors 300, 400, 500, 600, and 300*a* preferably include two rows of contacts 100, 100', 200, 100*a*, and 200*a*. However, the arrangement of contacts 100, 100', 200, 100*a*, and 200*a* is not so limited. For example, only a single row of contacts 100, 100', 200, 100*a*, and 200*a* could be arranged in one of the connectors 300, 400, 500, and 600, or multiple rows (e.g., four) could be provided. Furthermore, spacing between adjacent contacts 100, 100', and 200 could be adjusted according to positioning of ground contacts, including high-voltage contacts, or other design requirements.

The contacts 100, 100', 200, 100*a*, and 200*a* according to the preferred embodiments of the present invention preferably have a flat profile, and are preferably formed by stamping so as to provide no raised portions, as shown, for example, in FIG. 4.

Although only connector 400 is described above as being mounted to the substrate 800, each of the connectors 300, 400, 500, 600, and 300*a* may be mounted to the substrate 800, which is typically a printed circuit board.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A connector comprising:

a connector body;

at least one first contact and at least one second contact disposed in the connector body, the at least one first contact and the at least one second contact each including:

a tail with a leg extending therefrom; and an arm with a contact section arranged to electrically couple with a corresponding contact when the connector is mated to an electrical device or another connector; wherein the leg of each of the at least one first contact is offset with respect to the leg of each of the at least one second contact and is located completely outside of the connector body when viewed from a mating direction of the connector; and the leg of each of the at least one first contact and the at least one second contact is configured and arranged to be press-fit into a mounting hole of a substrate.

2. The connector of claim 1, wherein the tail of each of the at least one first contact is shorter than the tail of each of the at least one second contact.

3. The connector of claim 1, wherein the tail of each of the at least one first contact is arranged to be the same or substantially the same as the tail of each of the at least one second contact.

4. The connector of claim 1, wherein the tail of each of the at least one first contact includes a stub arranged to separate the leg of each of the at least one first contact from an end of each of the at least one first contact by a predetermined distance.

5. The connector of claim 1, wherein the leg of each of the at least one second contact is arranged at an end of each of the at least one second contact.

6. The connector of claim 1, wherein the at least one first contact and the at least one second contact each further include a barb arranged to fit one of a plurality of barb holes of the connector.

7. The connector of claim 6, wherein the barb of each of the at least one first contact and the at least one second contact is tapered.

8. The connector of claim 7, wherein the barb of each of the at least one first contact and the at least one second contact is tapered at an angle of less than about 90 degrees.

9. The connector of claim 1, wherein the leg of each of the at least one first contact and the at least one second contact is offset with respect to the arm of the at least one first contact and the at least one second contact.

10. The connector of claim 9, wherein:

the at least one first contact and the at least one second contact each further include a base section; and the leg, the arm, and the barb of each of the at least one first contact and the at least one second contact are arranged along the base section of each of the at least one first contact and the at least one second contact, such that the barb is disposed between the leg and the arm.

11. The connector of claim 1, wherein the leg of each of the at least one first contact and the at least one second contact is perpendicular or substantially perpendicular to the arm of the at least one first contact and the at least one second contact.

12. The connector of claim 1, wherein the at least one first contact and the at least one second contact are arranged in an alternating manner in the connector.

13. The connector of claim 1, wherein the at least one first contact and the at least one second contact are arranged in at least one row in the connector body of the connector.

14. The connector of claim 13, wherein the at least one first contact and the at least one second contact are parallel or substantially parallel with respect to each other.

15. The connector of claim 13, wherein the connector body extends to an end of each of the tails of each of the at least one first contact and the at least one second contact.

16. The connector of claim 13, wherein a portion of at least one of the tails of the at least one first contact and the at least one second contact extends outside of the connector body.

17. The connector of claim 13, wherein the connector body includes a plastic material.

18. A connector assembly comprising:

a substrate including a plurality of mounting holes; and a connector including a connector body and at least one first contact and at least one second contact; wherein the at least one first contact and the at least one second contact of the connector each include a tail with a leg extending therefrom and an arm with a contact section arranged to electrically couple with a corresponding contact when the connector is mated to an electrical device or another connector;

the leg of each of the at least one first contact is offset with respect to the leg of each of the at least one second contact and is located completely outside of the connector body when viewed from a mating direction of the connector; and the leg of each of the at least one first contact and the at least one second contact is arranged to be press-fit into a corresponding one of the plurality of mounting holes of the substrate.

19. The connector assembly of claim 18, wherein the substrate is a printed circuit board.

* * * * *